US010617179B2

(12) United States Patent
Fiedler et al.

(10) Patent No.: US 10,617,179 B2
(45) Date of Patent: Apr. 14, 2020

(54) CLOSURE DEVICE

(71) Applicant: Fidlock GmbH, Hannover (DE)

(72) Inventors: Joachim Fiedler, Hannover (DE); Artur Tucholke, Hannover (DE)

(73) Assignee: Fidlock GmbH, Hannover (DE)

( * ) Notice: Subject to any disclaimer, the term of this patent is extended or adjusted under 35 U.S.C. 154(b) by 182 days.

(21) Appl. No.: 15/318,470

(22) PCT Filed: Jun. 19, 2014

(86) PCT No.: PCT/EP2014/062966

§ 371 (c)(1),
(2) Date: Dec. 13, 2016

(87) PCT Pub. No.: WO2015/192907

PCT Pub. Date: Dec. 23, 2015

(65) Prior Publication Data

US 2017/0127764 A1 May 11, 2017

(51) Int. Cl.

| | |
|---|---|
| ***A44B 11/25*** | (2006.01) |
| ***A44B 11/12*** | (2006.01) |
| ***A45C 13/10*** | (2006.01) |
| ***A44B 19/40*** | (2006.01) |
| ***A44B 99/00*** | (2010.01) |

(Continued)

(52) U.S. Cl.

CPC ..... *A44B 11/12* (2013.01); *A41F 1/002* (2013.01); *A44B 11/10* (2013.01); *A44B 11/22* (2013.01); *A44B 11/24* (2013.01); *A44B 11/2557* (2013.01); *A44B 11/2569* (2013.01); *A44B 11/2588* (2013.01); *A44B 19/403* (2013.01);

(Continued)

(58) Field of Classification Search

CPC ..... A44B 11/12

See application file for complete search history.

(56) References Cited

U.S. PATENT DOCUMENTS 3,293,714 A * 12/1966 Shafer ..... A44B 11/2596 24/303

3,482,288 A 12/1969 Curran (Continued)

FOREIGN PATENT DOCUMENTS

DE 1849648 U 4/1962
FR 1193277 A 11/1959

(Continued)

*Primary Examiner* — Jason W San

(74) *Attorney, Agent, or Firm* — The Webb Law Firm

(57) ABSTRACT

A closure device for releasably connecting two parts with each other includes a first closure member having a rigid first locking protrusion and a second closure member which is attachable to the first closure member and in a closed position is held on the first closure member. The second closure member has a rigid second locking protrusion. The second locking protrusion can be brought into engagement with the first locking protrusion in an engagement direction and in the closed position engages the first locking protrusion in a positive locking manner. The first closure member includes a first magnetic member and the second closure member includes a second magnetic member, the first magnetic member and the second magnetic member being constituted to magnetically attract each other when the second closure member is attached to the first closure member for closing the closure device.

3 Claims, 26 Drawing Sheets

(51) Int. Cl.

| | |
|---|---|
| ***A41F 1/00*** | (2006.01) |
| ***A44B 11/10*** | (2006.01) |
| ***A44B 11/22*** | (2006.01) |
| ***A44B 11/24*** | (2006.01) |

(52) U.S. Cl.
CPC ..... *A44B 99/00* (2013.01); *A45C 13/1069* (2013.01); *A44D 2203/00* (2013.01)

(56) References Cited

U.S. PATENT DOCUMENTS 5,377,392 A * 1/1995 Morita ..... A41F 1/002 24/303
5,664,298 A * 9/1997 Nessar-Ivanovic ..... A44C 5/2071 24/303
5,826,309 A * 10/1998 Tsamas ..... A44C 5/2052 24/68 J
6,163,938 A * 12/2000 Weber-Unger ..... A41F 1/002 24/303
6,292,985 B1 * 9/2001 Grunberger ..... A44B 11/2592 24/303
6,360,410 B1 3/2002 Lovato
6,505,385 B2 * 1/2003 Grunberger ..... A44B 11/2592 24/303
6,598,271 B2 * 7/2003 Nire ..... A41F 1/002 24/265 WS
6,698,070 B2 * 3/2004 Chen ..... A44B 11/006 24/185
6,804,865 B2 * 10/2004 Grunberger ..... A41F 1/002 24/303
6,857,169 B2 * 2/2005 Chung ..... A44B 11/258 24/303
7,496,994 B1 * 3/2009 Headley ..... A44C 5/2019 24/303
8,359,716 B2 * 1/2013 Fiedler ..... A44B 11/25 24/303
8,505,174 B2 * 8/2013 Fildan ..... A41F 1/002 24/303
9,307,808 B1 * 4/2016 Lill ..... A44B 11/2584
9,635,919 B2 * 5/2017 Fiedler ..... A45C 13/10
9,907,367 B2 * 3/2018 Paik ..... A41F 1/002
9,936,772 B2 * 4/2018 Paik ..... A44B 11/2592
10,143,270 B2 * 12/2018 Fiedler ..... A44B 11/2584
2003/0229974 A1 12/2003 Zemer et al.
2006/0218761 A1 10/2006 Anscher
2010/0263171 A1 * 10/2010 Paik ..... A44B 11/25 24/194
2010/0283269 A1 11/2010 Fiedler
2012/0291227 A1 11/2012 Fiedler
2015/0135486 A1 * 5/2015 Fiedler ..... A44B 11/2584 24/303

FOREIGN PATENT DOCUMENTS

WO 2008006355 A2 1/2008
WO 2011095515 A1 8/2011
WO 2012095823 A1 7/2012
WO WO-2014090926 A1 * 6/2014 ..... A44B 11/2584
WO 2014180512 A1 11/2014

* cited by examiner

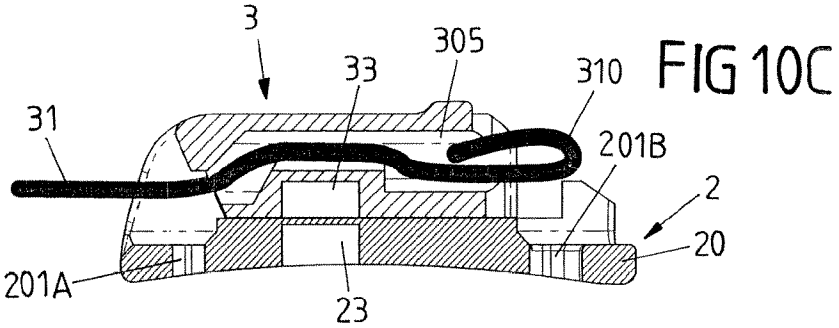
FIG 10C
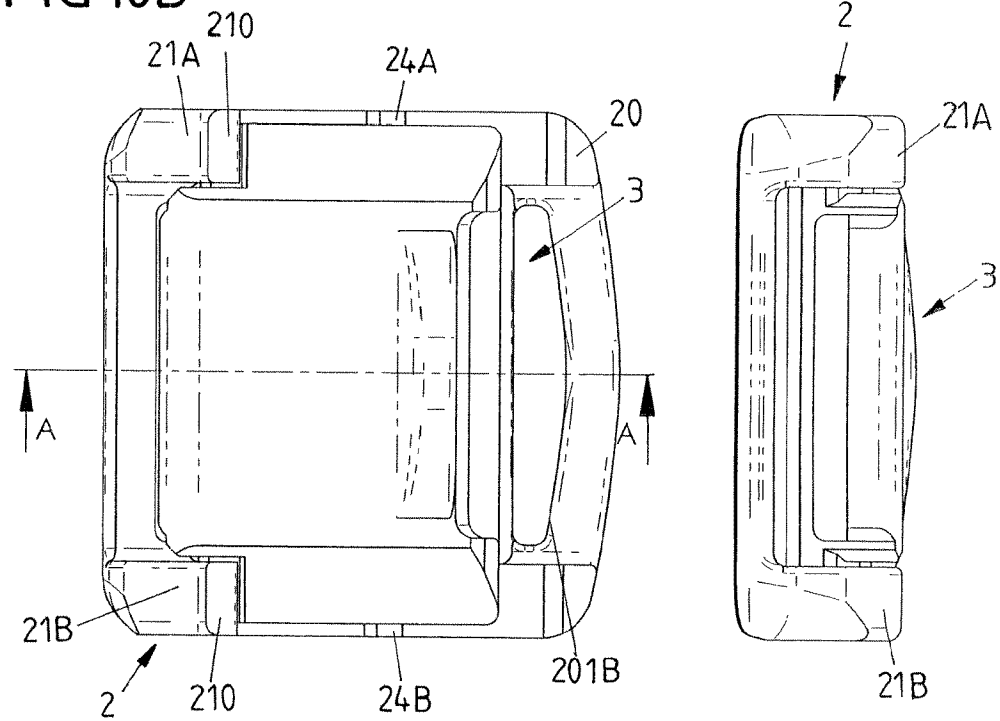
FIG 10D
FIG 10B
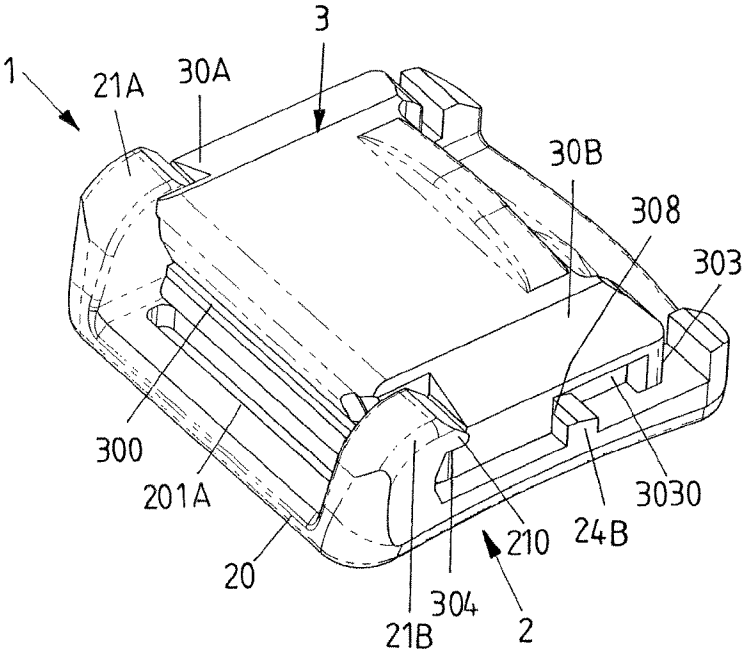
FIG 10A (A-A)

CLOSURE DEVICE

CROSS-REFERENCE TO RELATED APPLICATION

This application is the U.S. national phase of International Application No. PCT/EP2014/062966 filed Jun, 19, 2014, the disclosure of which is hereby incorporated in its entirety by reference.

BACKGROUND OF THE INVENTION

The invention relates to a closure device for releasably connecting two parts with each other.

A closure device of this kind comprises a first closure member having a rigid first locking protrusion and a second closure member having a rigid second locking protrusion. The second closure member is attachable to the first closure member and in a closed position is held on the first closure member such that parts connected with the closure members are connected with each other. For closing the closure device the second locking protrusion can be brought into engagement with the first locking protrusion in an engagement direction and in the closed position then engages the first locking protrusion in a positive locking manner.

The first closure member furthermore comprises a first magnetic member and the second closure member comprises a second magnetic member. The first magnetic member and the second magnetic member are constituted to magnetically attract each other when the second closure member is attached to the first closure member, hence supporting the closing of the closure device by generating an attraction force pulling the closure members into engagement with each other.

In a closure device as disclosed in U.S. Pat. No. 5,664,298 two closure members are provided which each comprise a locking protrusion. The locking protrusions can be brought into engagement with each other and, in a closed position of the closure device, are fittingly held together in a positive locking manner. Two magnets are arranged on each closure member to ensure that the closure members cannot be separated from each other in an unintentional manner. The closure device of U.S. Pat. No. 5,664,298 serves as a closure for jewelry and hence is not suited for carrying large loads.

In a closure device as known from US 2003/0229974 A1, also serving as a closure for jewelry, a first closure member can be brought into a positive locking engagement with a second closure member, wherein the engagement is secured, in a closed position of the closure device, by means of magnets.

There is a desire for closure devices which are easy to close, can comfortably be opened and at the same time can provide a high-strength closure which can carry large loads, as it is required for example for safety closures which must not open even if excessive loads act onto the closure.

SUMMARY OF THE INVENTION

It is an object of the invention to provide a closure device which can easily and comfortably be handled and at the same time is suitable to take on large loads and which may be used in connection with clothes without further ado.

This object is in particular achieved with a closure device comprising the features as described herein.

Accordingly, the closure device comprises a force application element in the form of a strap or belt attached to the second closure member at a force application location in the vicinity of the second locking protrusion, the force application element being constituted to introduce a force into the second closure member and being adjustably attached to the second closure member in such a way that a length of the strap or belt, being defined as the extension of the strap or belt from the second closure member, may be adjusted at the second closure member.

The force application element may be for example pivotable about a pivot axis on the second closure member. The pivot axis herein constitutes the force application location and hence assumes the shape of a line.

The force application element may be adjustably attached to second closure member via a ladderlock or buckle element of the second closure member at which the force application element in the form of the strap or belt is deflected at least once. The deflection of the strap or belt at such a ladderlock or buckle element, as it is known from, e.g., from conventional ladderlocks or buckles at hip belts, bags or rucksacks, serve for a force-fitting attachment of the strap or belt which may be easily released.

In another embodiment the force application element is adjustably attached to second closure member via a clamp element of the second closure member which may clamp a section of the force application element in the form of the strap or belt in a force-fitting and/or form-fitting manner. The clamp element may be manually shifted, for example, swivelled between at least one open and one closed state. The length of the strap or belt may than only be adjusted in an open state of the clamp element, whereas its position at the second closure member remains fixed in a closed state of the clamp element.

The clamp element may be self-locking so that a displacement of the strap or belt relative to the second closure member is locked by the clamp element and is merely possible as long as the clamp element is properly actuated by a user. In such an embodiment, the length of the belt or strap may be merely adjusted as intended as long as a manual force is applied to clamp element in order to hold it in an open and release position.

In this context, an embodiment may be provided in which the closure device comprises a cord stopper at the second closure member and the clamp element constitutes a part of the cord stopper. An exemplary cord stopper may include a wedge-shaped clamp recess in which the strap or belt run when its lengths is adjusted and at least one clamp element which is adjustably mounted within the clamp recess. The clamp element interacts with at least one spring element pretensioning the clamp element towards the smaller and/or narrower part of the clamp recess. The clamp element thus clamps a section of a strap or belt at the clamp recess when the clamp element, against a spring force of the at least one spring element, is not held in an open and release position in which the clamp element is retracted.

Generally, the clamp element may comprise an excentric and/or wedge-shaped clamp body in order to effectively clamp the strap or belt at the second closure element.

In another variant, which may be combined with the previously mentioned embodiments comprising a clamp element, the second closure member comprises a protruding form-fit element and the strap or belt has at least two holes into which the protruding form-fit element may selectively engage in order to attach the strap or belt in at least two different positions at the second closure member. A length of the strap of belt may thus be easily adjusted by just changing the engagement of the form-fit element from one hole to another. The form-fit element may be, e.g., formed as cylindrical pin protruding from a middle portion of the second closure member.

Additionally, a securing element may be provided at the second closure element which may be shifted between at least one open and one closed state at the second closure element. In a closed state of the securing element the engagement of the form-fit element in one of the holes of the strap of belt is secured by the securing element, e.g., by preventing or limiting a displacement of the strap or belt section comprising the used hole with respect to the form-fit element. In the open state of the securing element the strap or belt may be disengaged from the form-fit element in order to adjust its length. In one embodiment the securing element is mounted at the second closure member so that it may be swivelled between the at least one open and at least one closed state.

In one exemplary embodiment the first closure member defines at least two attachment sections so that at least two second closure members may be attached to the first closure member at the same time. The first closure member in this embodiment thus, e.g., comprises one base with several pre-defined areas to which a second closure member may be respectively mounted. For holding the several second closure members at the single first closure member the first closure member may comprise several locking elements with protrusions for the respective second closure members.

Furthermore, the first closure member may comprise several first magnetic members each for one second closure member or may just comprise a single first magnetic member dimensioned and arranged so that it may interact with each of the second magnetic members of the several second closure members.

In one embodiment, the first closure member comprises a base and a locking element rigidly attached to the base and carrying the first locking protrusion. The second closure member, in turn, comprises a locking part carrying the second locking protrusion and having a front face which in the closed position faces the locking member of the first closure member. The locking part with the first locking protrusion arranged thereon and the base herein beneficially form a U-shaped recess in which the locking part of the second closure member with its second locking protrusion engages in the closed position such that the second closure member with its second locking protrusion is held in a positive locking manner in the U-shaped recess formed by the first locking protrusion, the locking element and the base of the first closure member.

The force application location, i.e. the location at which the force application element engages, herein in one embodiment may be located, in the closed position of the closure device, between the front face of the second closure member and a center of the first magnetic member of the first closure member. The center of the first magnetic member may be determined by a geometric center or a center of mass of a magnet or magnetic armature constituting the first magnetic member. Because the force application location lies in between the front face of the second closure member and the center of the first magnetic member of the first closure member, it is ensured that a beneficial leverage for holding the second closure member in engagement with the first closure member by means of the magnetic attraction force between the magnetic members of the first closure member and the second closure member exists. Because the force application location lies in between the front face and the center of the first magnetic member, a force acting at the force application location will act with a leverage arm which is smaller than the leverage arm of the magnetic attraction force caused by the magnetic members such that a fairly small magnetic attraction force may be sufficient to ensure that the closure members are held in engagement with each other even at fairly large loads acting via the force application element at the force application location on the second closure member.

The first locking protrusion, in a specific embodiment, forms a first leg and the base forms a second leg of the U-shaped recess, the first leg and the second leg extending substantially parallel to each other. The second closure member in this case, in the closed position of the closure device, engages the U-shaped recess with its second locking protrusion, wherein the second locking protrusion in the closed position abuts the first locking protrusion on the inside of the U-shaped recess.

As already outlined above, in one embodiment the first closure member comprises at least two spatially separated locking parts at a single base. Each of the locking parts has its own first locking protrusion being able to engage with a corresponding second locking protrusion of a second closure member. Two first locking parts may, e.g., respectively project from the base substantially perpendicular to the engagement direction. Furthermore, two locking parts may be provided at the first closure member for engagement with two second locking parts in the area of two different corner sections of the second closure member.

In another embodiment, the first closure member comprises a blocking element which, in the closed position, faces a back face of the second closure member. The back face herein faces in a direction opposite to the engagement direction and lies opposite the front face on the base of the first closure member. The blocking element is constituted to prevent the second locking protrusion from moving out of its engagement with the first locking protrusion in the direction opposite the engagement direction when the closure device is in its closed position. The blocking element hence serves to prevent the second closure member to move out of engagement with the first closure member in a direction opposite the engagement direction such that the second closure member cannot be released without further ado by displacing it against the engagement direction.

The provision of the blocking element may provide for a particularly strong closure device which is suitable to carry large loads as it is for example required for a safety closure such as for a motorbike helmet which must not open even if excessively large loads, vibrating loads or loads from different directions act onto the closure device. By means of the blocking element the risk for the closure device to be opened due to large loads acting onto the force application element attached to the second closure member is substantially reduced because a sliding of the second closure member out of engagement with the first closure member against the engagement direction is prevented.

In a further embodiment, the second closure member may comprise a support element attached to the locking part and extending, in the direction opposite to the engagement direction, beyond the locking part. The support element is constituted to prevent an abutment of the back face with the blocking element prior to the second locking protrusion engaging the first locking protrusion when closing the closure device. When the second closure member is approached to the first closure member for closing the closure device, first the support element comes into abutment with the base of the first closure member and guides the movement of the second closure member relative to the first closure member such that the second locking protrusion can slide into engagement with the first locking protrusion without the blocking element hindering such movement.

The blocking element may be rigidly arranged on the base and may be shaped as a protrusion protruding from the base.

In another embodiment the blocking element however can also be elastically arranged on the base of the first closure member such that it can be deflected when the second closure member is attached to the first closure member for closing the closure device. Upon closing the closure device, the second closure member hence comes into abutment with the blocking element of the first closure member and deflects the blocking element such that the second closure member with its second locking protrusion can slide into engagement with the first locking protrusion of the first closure member. Once the second locking protrusion has reached its engagement position (in which it is in engagement with the first locking protrusion) the elastic blocking element snaps back into its original position in which it then blocks the second closure member from being slid out of its engagement with the first closure member in a direction opposite to the engagement direction.

In another embodiment the first locking protrusion, on a side which in the closed position faces away from the second locking protrusion, may comprise a slanted face. In addition or alternatively, also the second locking protrusion, on a side which in the closed position faces away from the first locking protrusion, may comprise a slanted face. In this way, it may be achieved that the second locking protrusion, when attaching the second closure member to the first closure member in a closing direction perpendicular to the engagement direction and perpendicular to a plane along which the base of the first closure member substantially extends, is guided past the first locking protrusion when closing the closure device in that the slanted faces of the locking protrusions come into contact with each other and the second locking protrusion may slide along the first locking protrusion until it can be moved into engagement with the first locking protrusion.

Herein, due to the second locking protrusion sliding on a slanted face when closing the closure device the second closure member is displaced by a certain distance against the engagement direction in order to be able to move the second locking protrusion past the first locking protrusion until the second locking protrusion can be moved into positive locking engagement with the first locking protrusion.

The closure device may be opened from its closed position in different ways.

First, the second closure member, for opening the closure device, may be pivotable with its second locking protrusion about the first locking protrusion in order to disengage the second locking protrusion from its positive locking engagement with the first locking protrusion.

Second, the second closure member may be displaceable in a direction perpendicular to the engagement direction and parallel to a plane in which the base of the first closure member substantially extends such that, by the displacement movement, the second locking protrusion slides along the first locking protrusion and hence is moved out of engagement with the first locking protrusion.

If the second closure member can be disengaged from the first closure member by pivoting it with respect to the first closure member, in addition it also is conceivable that the closure device may also be opened by displacing the closure members with respect to each other, such that in principle two opening movements are possible. For pivoting the second closure member relative to the first closure member a handle may be provided on the second closure member, which allows actuating the second closure member for pivoting it with its second locking protrusion about the first locking protrusion.

If the closure device shall be opened by means of pivoting the second closure member relative to the first closure member, it also is conceivable that the opening by displacing the second closure member with regard to the first closure member is blocked by means of additional side elements preventing a displacement movement of the second closure member relative to the first closure member in a direction perpendicular to the engagement direction and parallel to the plane of extension of the base of the first closure member.

If the closure device shall be opened by displacing the second closure member by sliding the second locking protrusion along the first locking protrusion, it is conceivable to provide no handle on the second closure member allowing for a pivoting of the second closure member. In this regard it is also conceivable that the displacement movement is only possible after for example the force application element is moved into a position in which it does not block the displacement movement. Also, an additional interlocking element may be provided which must be released prior to displacing the second closure member relative to the first closure member. Or it is conceivable to allow a displacement only in one direction by for example attaching the force application element to the second closure member in a way that an opening displacement movement is possible only in one direction.

The force application element is strap or belt attached to the second closure member. Also, the first closure member may carry a belt receptacle for fixing the first closure member to a strap or belt, such that via the closure device two straps or belts can be connected to each other.

The magnetic members may be arranged to generate an attractive force along the engagement direction or in a direction perpendicular to the engagement direction. In the first case the closure members are attracted such that they are pulled towards each other along the engagement direction. In the second case, the magnetic attraction force acts perpendicularly for example to a plane of extension of the base of the first closure member. In the first case magnets of the closure members or a magnet of one of the closure members and a magnetic armature of the other of the closure members face each other along the engagement direction. In the second case magnets of the closure members or a magnet of one of the closure members and a magnetic armature of the other of the closure members face each other in a direction perpendicular to the engagement direction.

On one or on each of the closure members multiple magnets facing the other closure member with opposite poles may be arranged. By such a magnet arrangement it can be ensured that the closure members are attached in the right orientation to each other when closing the closure device in that the magnets interact to move the closure members with respect to each other such that they face each other in a desired manner.

In a further embodiment, a magnetic field sensor may be provided on one of the closure members for sensing, in the closed position, a magnetic field produced by the magnetic members. Herein, the magnetic field sensor may detect the strength of the magnetic fields produced by the magnetic members. Or the magnetic field sensor may detect the position of one or both magnetic members of the closure members, for example the position of the magnetic member of the second closure member. By means of the magnetic field sensor a signal may be produced which indicates to a user if the closed position has been reached and whether it has been established in a correct manner such that a user receives a feedback about the closing of the closure device.

The object is furthermore achieved by a closure device for releasably connecting two parts with each other, comprising:

a first closure member having a rigid first locking protrusion and a second closure member which is attachable to the first closure member and in a closed position is held on the first closure member, the second closure member having a rigid second locking protrusion, wherein the second locking protrusion can be brought into engagement with the first locking protrusion in an engagement direction and in the closed position engages the first locking protrusion in a positive locking manner, wherein the first closure member comprises a first magnetic member and the second closure member comprises a second magnetic member, the first magnetic member and the second magnetic member being constituted to magnetically attract each other when the second closure member is attached to the first closure member for closing the closure device.

Herein, a force application element is attached to the second closure member at a force application location in the vicinity of the second locking protrusion the force application element being constituted to introduce a force into the second closure member, wherein the closure device comprises at least two first and/or two second closure members being coupled with each other by means of at least one coupling element.

Herein, the force application element is not limited to a strap or belt and may, for example, be a bracket pivotable about a pivot axis on the second closure member or may be a rope, a chain or a cable pivotable about a pivot point on the second closure member. Nevertheless, a closure device with a coupling element may naturally comprise a force application element in the form of a strap or belt being adjustably attached to a second closure element, so that the advantages and advantageous embodiments described above equally apply such that the closure device may be combined with any of the features described above.

In one embodiment of the closure device a coupling element is provided via which an opening force may be transmitted from one pair of first and second closure members to another pair when the first and second closure members of the one pair are detached in order to also effect a detachment of the first and second closure members of the other pair. Depending on the arrangement of the different pairs with respect to each other and/or the degree of flexibility of the at least one coupling element or of several coupling elements used detachment of a first and second closure member of one pair effects a simultaneous or subsequent detachment of first and second closure members of at least one other pair. If, e.g., a rigid coupling element is used connecting two first closure members displacement of one first closure member will also directly effect a displacement of the other first closure member. Whereas, if a at least partially flexible coupling element is provided, a initial displacement of one first closure member will firstly —preferably elastically—deform the coupling element before a force is transmitted via the coupling element also displacing the other first closure member.

In one embodiment the pairs of first and second closure members are arranged and coupled via the at least one coupling element in such a way that detachment of a first and second closure member of one pair effects a subsequent detachment of first and second closure members of at least one other pair. Accordingly, several pairs may be subsequently detached by just pulling at one of the detached first and second closure members of one pair. This also allows for a closure device in which the respective pairs may be subsequently detached in a zipper-like manner by just pulling at a first or second closure member of one pair. An opening force may be thus gradually transmitted from one pair to the next in order to completely open a closure device comprising several pairs of first and second closure members.

A closure device comprising at least two first and/or at least two second closure members each engaging with another corresponding second or first closure member or all engaging with a single second or first closure member, respectively, in a positive-locking manner when the closure device is closed may be designed as a pre-assembled module. At least one flexible coupling element, e.g., comprising rope, chain, cable, strap or belt, or several flexible coupling elements may allow of the flexible connection between several first and/or second closure members so that a module formed therewith may be at least partially flexible as well in the area of the coupling element(s). This could ease the mounting of such a module to flexible parts like clothes, in particular jackets or the like.

Generally, a second closure member of one pair of first and second closure members may be connected to a second closure member of another pair by means of the at least one coupling element and/or a first closure member of one pair may be connected to a first closure member of another pair by means of the at least one coupling element.

In one embodiment a coupling element, by means of which a second closure member of one pair is connected to a second closure member of another pair, is rigidly fixed to at least one of the second closure members. In a modification of such an embodiment at least one locking part of a second closure member comprising the second locking protrusion forms a part of the rigid coupling element. Thus, a detachment of this second closure member and its corresponding first closure member directly results in applying a force to coupling element which may be transmitted to the other second closure member.

A coupling element, by means of which a first closure member of one pair is connected to a first closure member of another pair, may furthermore be is releasably fixed to at least one of the closure members by means of a ladderlock or buckle element and/or a clamp element. In addition or in the alternative the coupling element may comprise an elongated portion that extends through several first closure members and/or the first closure members may be slideably placed at an elongated strap- or belt-like coupling element and fastened in desired positions at it by means of the at least one fastening element.

In one embodiment a coupling element is rigidly attached to the first and/or the second closure member by molding. This may in particular mean that the coupling element is made of the same material as the respective first or second closure member and extends from a base of this closure member to another one or that a coupling element made of a different material than the respective first or second closure member is partially embedded within the material thereof.

The object is furthermore achieved by a closure device for releasably connecting two parts with each other, comprising:

a first closure member having a rigid first locking protrusion and a second closure member which is attachable to the first closure member and in a closed position is held on the first closure member, the second closure member having a rigid second locking protrusion, wherein the second locking protrusion can be brought into engagement with the first locking protrusion in an engagement direction and in the closed position engages the first locking protrusion in a positive locking manner, wherein the first closure member comprises a first magnetic member and the second closure member comprises a second magnetic member, the first magnetic member and the second magnetic member being constituted to magnetically attract each other when the second closure member is attached to the first closure member for closing the closure device.

Herein, a force application element in the form of a strap or belt is attached to the second closure member at a force application location in the vicinity of the second locking protrusion, the force application element being constituted to introduce a force into the second closure member and being rigidly attached to the second closure member in such a way that an end of the strap or belt is immovably secured at the second closure member.

For such a closure device the advantages and advantageous embodiments described above and having a coupling element equally apply such that the closure device may be combined with any of the features described above.

In contrast to adjustably attach the force application element in the form of a strap or belt to the second closure member as stated with respect to the first aspect of the present invention, however, a closure device is provided according to this further aspect in which an end of the strap or belt is immovably secured at the second closure member. Consequently, a predetermined length of the belt or strap may be not adjusted at second closure member but a more stable, rigid connection of the strap or belt to the second closure member is established.

The strap or belt may be directly, i.e., not via additional separate parts, attached to the second closure member.

In one embodiment the end of the strap or belt is rigidly attached to the second closure member by molding. In this context, the end of the strap or belt may, e.g., embedded in a material of which the second closure member is manufactured in order to provide a stable and reliable connection between the strap or belt and the second closure member which does not fail even under excessive loads.

Irrespective which aspects of the present invention are implemented by a closure device the magnetic members may be arranged to generate an attractive force along the engagement direction or in a direction perpendicular to the engagement direction in order to provide for a quick and precise engagement of the first and second closure members upon closing the closure device.

For all of the above it applies that no elastic parts need to be provided for the locking protrusions. This makes it possible to produce the first closure member and the second closure member as metallic parts, for example by means of extrusion profiles. Such extrusion profiles, from metal or plastics, may in an easy and cost efficient manner be fabricated yielding reliable, high-strength parts. Due to the easy structural build of the closure device the closure device in addition is not prone to dirt and hence provides a reliable closure which is suited for a large range of different uses and applications, for example closures for holsters, jackets or clothes in general, dog collars or other collars or leashes, helmet closures, closures for orthoses or prostheses, and closures for doors, cases, musical instrument cases, bags, (water-tight) containers such as dry bags.

BRIEF DESCRIPTION OF THE DRAWINGS

The idea underlying the invention shall subsequently be described in more detail with regard to the embodiments shown in the figures. Herein:

FIGS. 2A-7A show perspective views of the closure device in different positions;

FIGS. 2B-7B show a top view of the closure device in the states according to FIGS. 2A to 7A;

FIGS. 2C-7C show sectional views along lines A-A to F-F according to FIGS. 2B to 7B;

FIGS. 10A-10D show a first embodiment of a closure device according to the invention in four different views;

FIGS. 14A-14D show different views of a further embodiment of a closure device according to the invention and comprising a first closure member to which several second closure member may be attached at the same time;

FIGS. 16A-16F show different views of a modified closure device based on the embodiment of FIGS. 15A-15E in which the second closure element comprising an additional securing element for preventing the attached strap or belt from being disengaged from the form-fit element, wherein FIGS. 16A-16F illustrate a closed state of the securing element;

DETAILED DESCRIPTION OF THE INVENTION

Figure 1A:
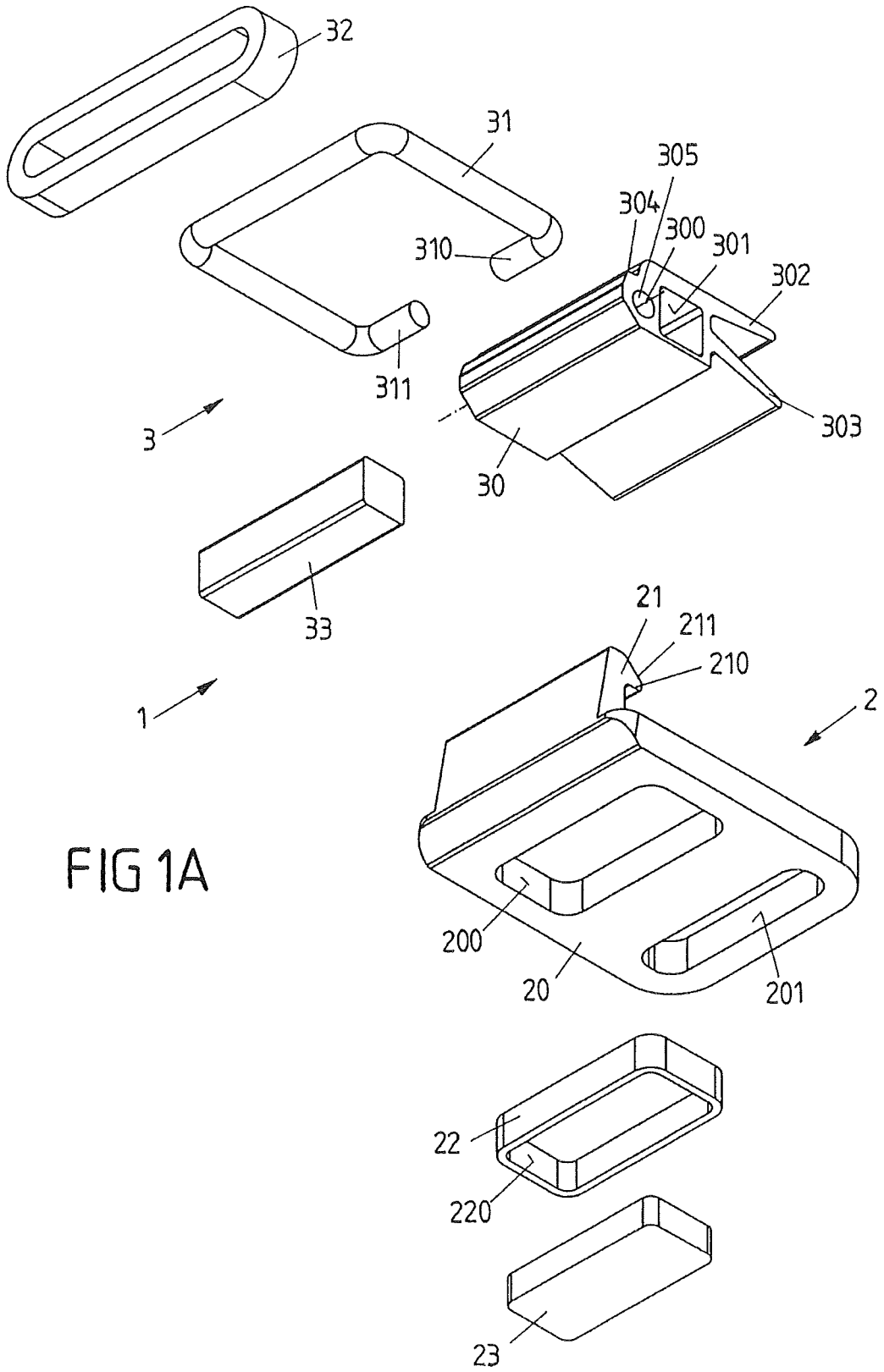
FIGS. 1A, 1B show perspective explosive views of an embodiment of a closure device.
Figure 1B:
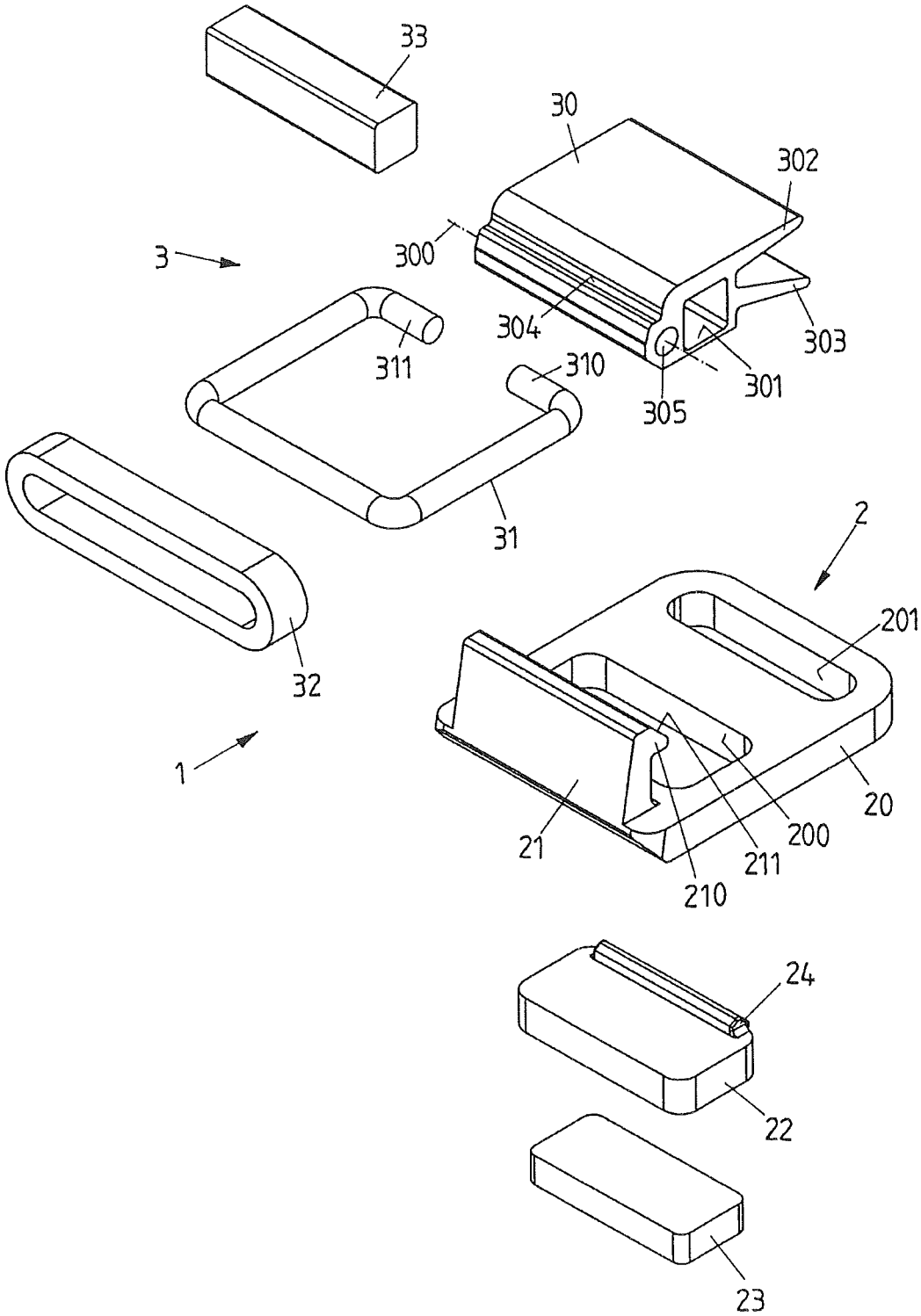

FIGS. 1A, 1B to 9A to 9D show embodiments of a closure device disclosed in international patent application PCT/EP 2013/060762 which is incorporated herein by reference. On the basis of these figures some features of exemplary embodiments according to the present invention shall be illustrated which are shown in the further accompanying drawings of FIGS. 10A to 19F.

According to FIGS. 1A, 1B to FIGS. 7A to 7C subsequently an embodiment of a closure device 1 shall be explained comprising a first closure member 2 and a second closure member 3.

Herein, the first closure member 2 comprises a base 20 carrying a locking element 21 with a locking protrusion 210. The locking element 21 is rigidly attached to the base 20, extends from the base 20 and carries the rigid locking protrusion 210. The base 20 and the locking element 21 with the locking protrusion 210 may beneficially be formed in one piece from plastics or metal.

The base 20 comprises an opening 200 into which a magnet housing 22 receiving, in a reception opening 220, a magnetic member 23 in the shape of a magnet or a magnetic armature is inserted such that the magnetic member 23 is fixedly held on the base 20. The base 20 furthermore has a belt receptacle 201 to which a belt can be attached.

A second closure member 3 comprises a locking part 30 carrying a locking protrusion 304 and having a longitudinally extended opening 300 for attaching a force application element 31 in the shape of a bracket to the locking part 30. The locking part 30 furthermore has a central opening 301 into which a magnetic member 33 in the shape of a magnet or a magnetic armature can be inserted such that the magnetic member 33 is fixedly held on the locking part 30.

From the locking part 30 a handle 302 and a support element 303 extend. The handle 302 serves to actuate the locking part 30 for opening the closure device 1 from a closed position. The support element 303 serves to ensure that the locking part 30 can be attached to the first closure member 2 in an easy, comfortable, reliable way, as shall be explained subsequently in more detail.

Attached to the force application element 31 in the shape of the bracket is a securing element 32 which reaches around the bracket 31 in a state in which it is attached to the bracket 31. The securing element 32 together with the bracket 31 serves as a belt receptacle for attaching a belt to the second closure member 3. Furthermore, the securing element 32 serves to secure the bracket 31 on the locking part 30 after the bracket 31 has been attached to the locking part 30 by inserting its two ends 310, 311 into the longitudinal opening 305 of the locking part 30.

The force application element 31 in the shape of the bracket is, when it is attached to the locking part 30, pivotable relative to the locking part 30 around a longitudinal axis 300. The longitudinal axis 300 in this case forms a force application location in that along this axis 300 forces acting onto the force application element 31 are inserted into the locking part 30.

Figure 6A:
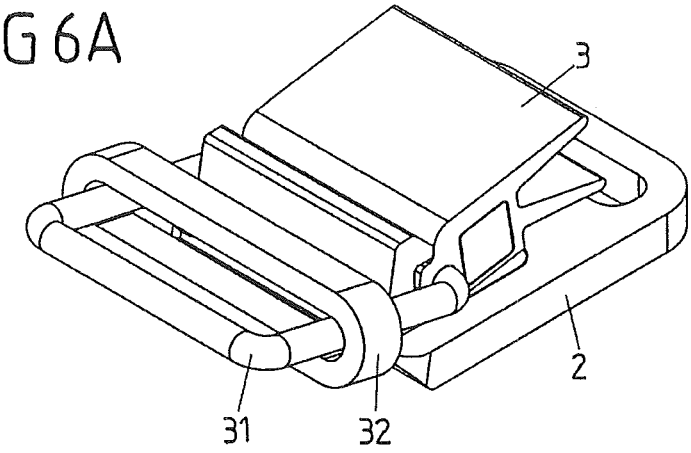
Figure 6B:
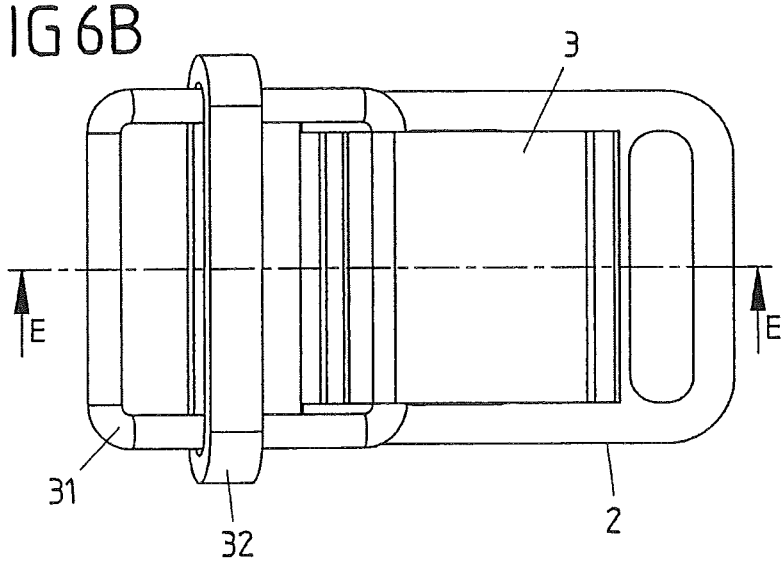
Figure 6C:
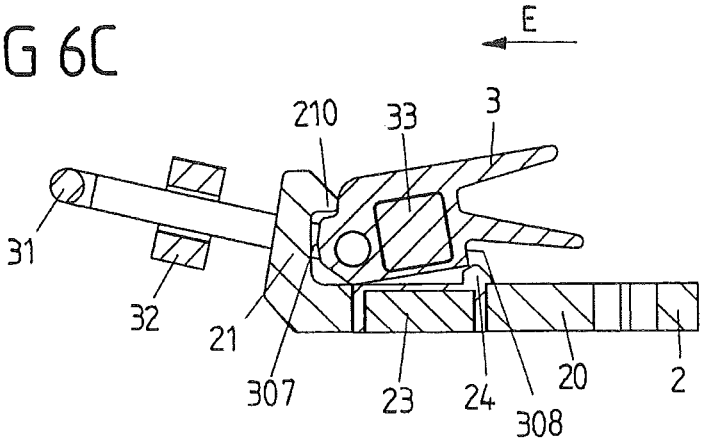
Figure 7A:
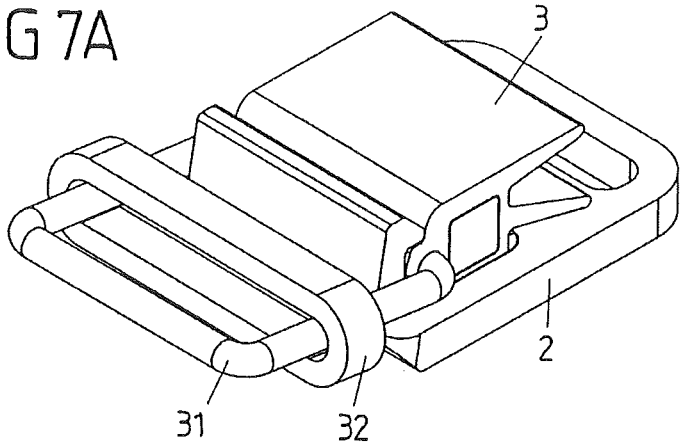

FIGS. 2A to 2C to 7A to 7C show the closure device 1 in different positions. Herein, FIGS. 2A to 7A show the closure device 1 in perspective views in an open state (FIG. 2A), during the closing of the closure device 1 (FIGS. 3A to 6A) and in a closed position (FIG. 7A). FIGS. 2B to 7B show corresponding top views, and FIGS. 2C to 7C show corresponding sectional views.

Figure 2A:
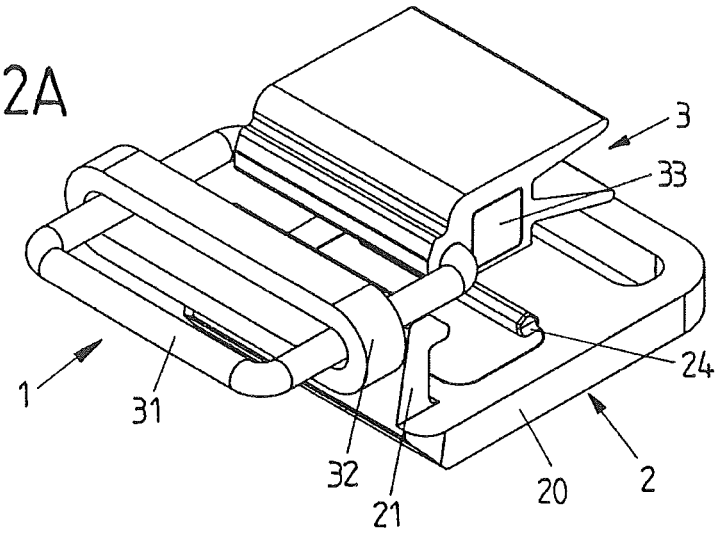
Figure 2B:
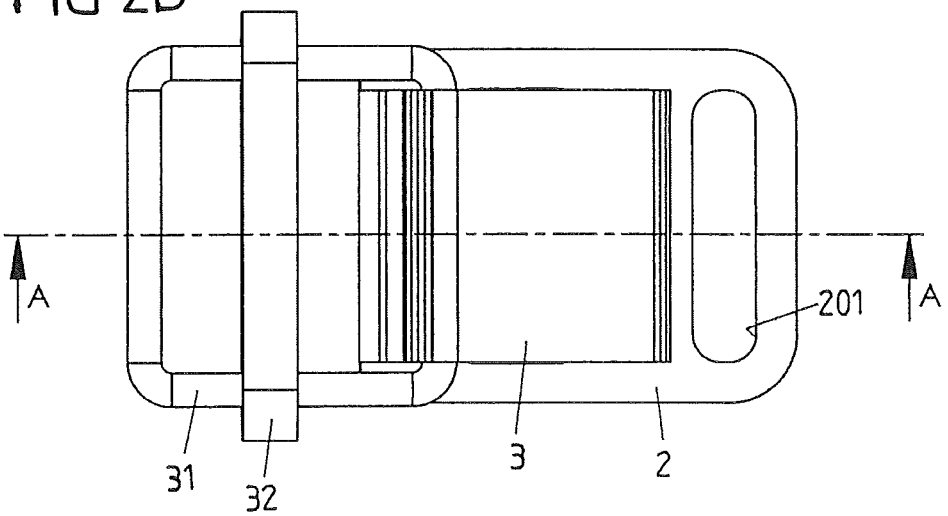
Figure 2C:
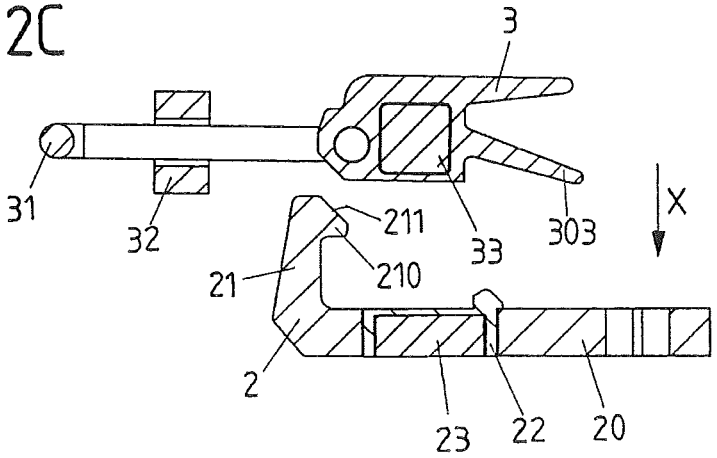

In an opened position, prior to closing, the closure members 2, 3 are separated from each other and may be attached to each other by approaching the second closure member 3 to the first closure member 2 in a closing direction X, which is substantially perpendicular to the base 20 of the first closure member 2 (see FIG. 2C).

Figure 3A:
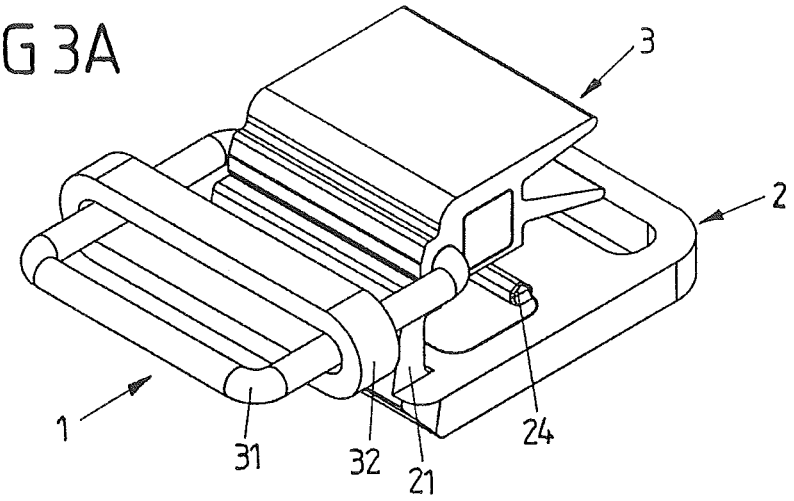
Figure 3B:
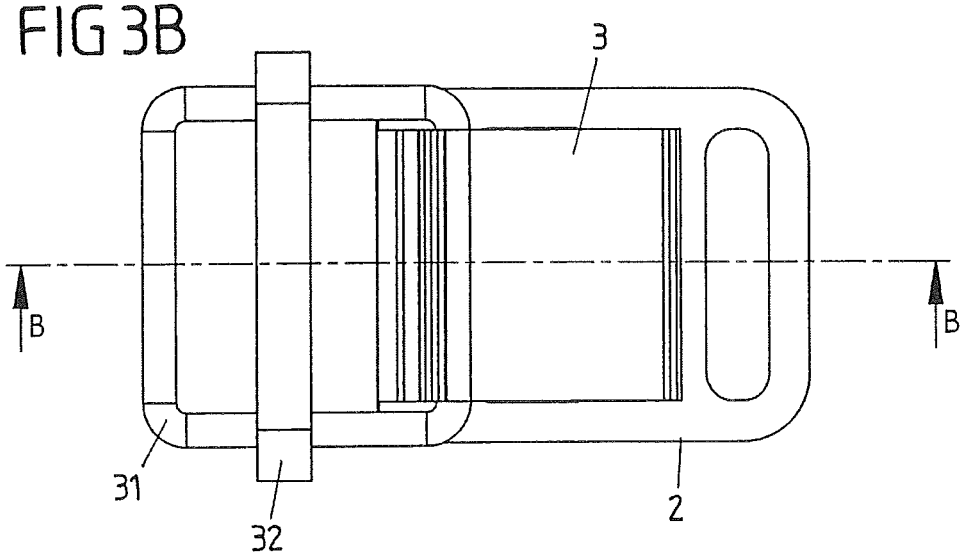
Figure 3C:
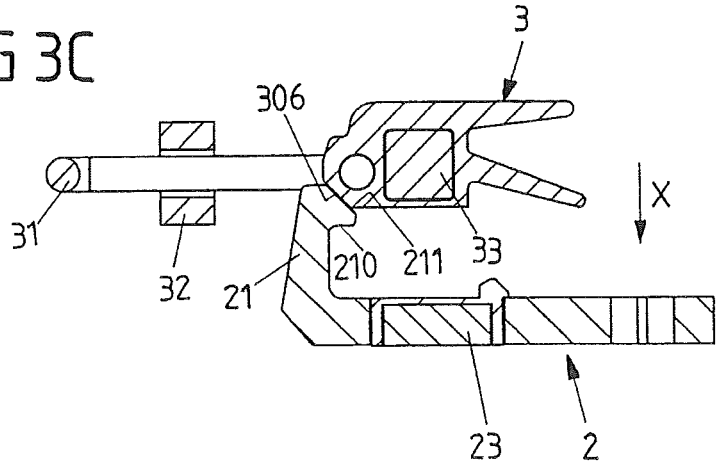

When closing the closure device 1, as shown in FIG. 3C, the second closure member 3 approaches the first closure member 2 in the closing direction X, wherein the magnetic members 23, 33 of the closure members 2, 3 generate a magnetic attraction force supporting the approaching movement of the closure members 2, 3 such that the closure members 2, 3 are magnetically pulled together and the closing movement is magnetically supported. When the second closure member 3 approaches the first closure member 2, it comes, via a tilted face 306 on the locking part 30, into contact with a tilted face 211 of the lock protrusion 210 of the first closure member 2. The tilted face 306 is arranged on a front end of the locking part 30 at a position opposite to the locking protrusion 304 of the locking part 30.

Figure 4A:
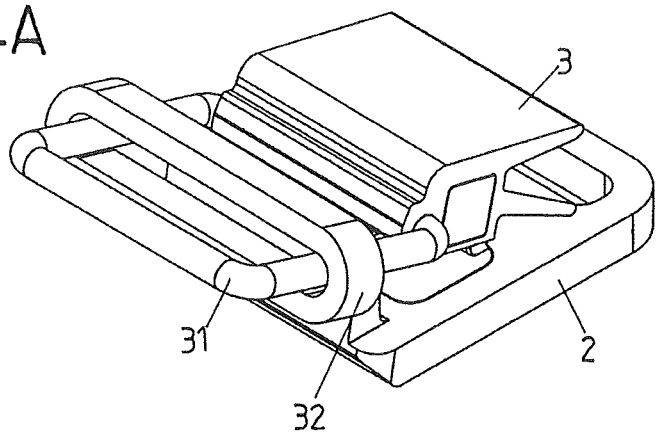
Figure 4B:
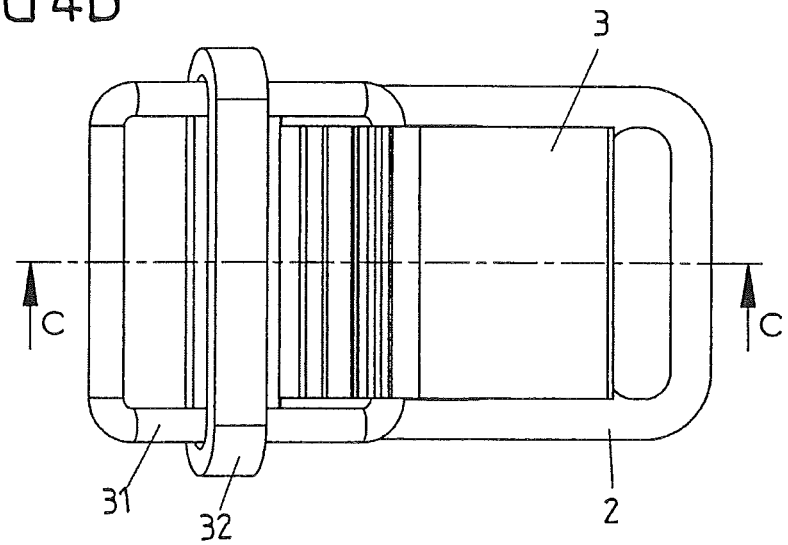
Figure 4C:
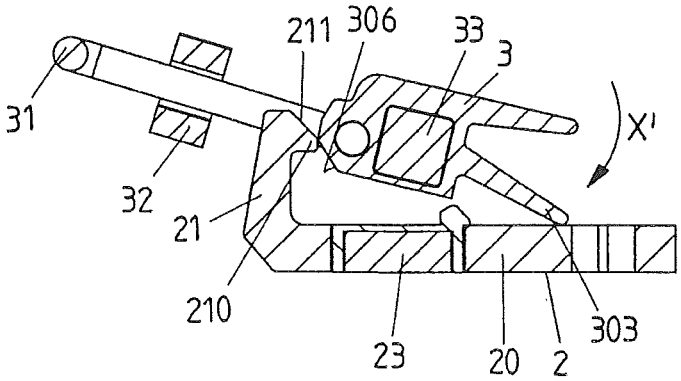

When the second closure member 3 further approaches the first closure member 2, as it is shown in FIG. 4C, the tilted face 306 slides along the tilted face 211 on the locking protrusion 210. The locking part 30 hence is moved past the locking protrusion 210.

Figure 5A:
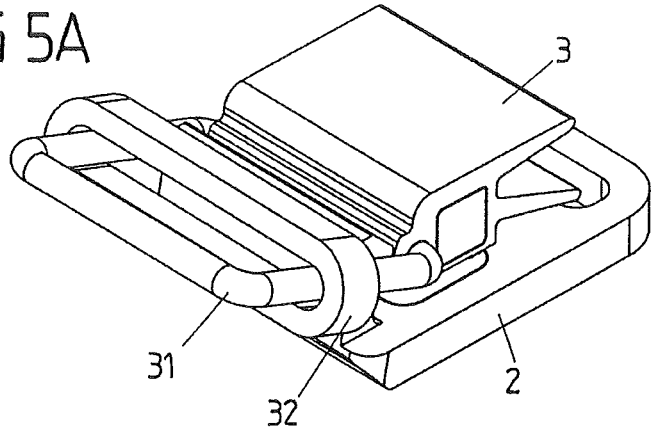
Figure 5B:
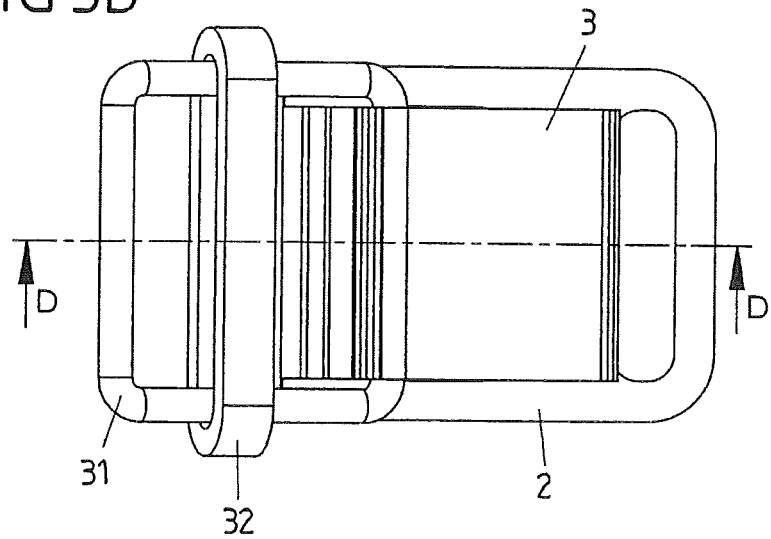
Figure 5C:
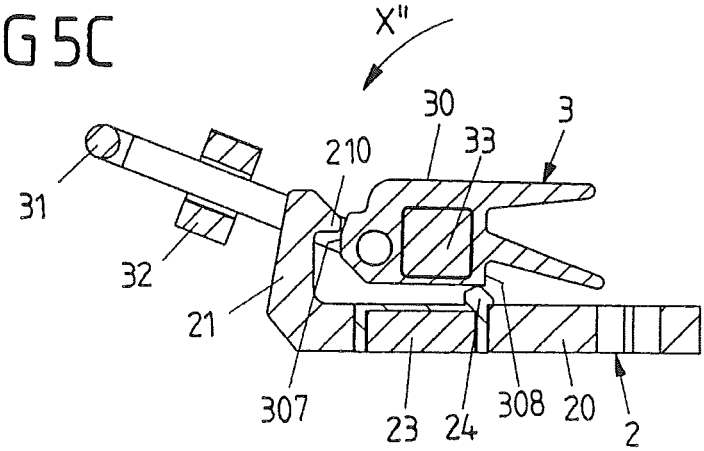

As the magnetic members 23, 33 attract each other at increasing strength the first closure member 3 may pivot such that the support member 303 approaches the base 20 of the first closure member 2 (tilting direction X') and comes into abutment with the base 20. Because the support element 303 comes into abutment with the base 20 and hence supports the locking part 30 on the base 20, the further approaching movement of the first closure member 3 is guided by the support element 303 slidingly moving with its far end along the base 20. This in particular prevents that a back face 308 of the locking part 30 (see FIG. 5C) can come into contact with a blocking element 24 arranged on the base 20 prior to a front face 307 of the locking part having been moved past the locking protrusion 210 of the first closure member, as is shown in FIG. 5C. In this way, it is prevented that the second closure member 3 can be jammed with its locking part 30 in a position which may prohibit the second closure member 3 to reach its closed position. Rather, as shown in FIG. 5C, the locking part 30 with its front face 307 is guided past the locking protrusion 210 of the locking element 21 of the first closure member, such that the second closure member 3 reaches the position shown in FIG. 6C.

In the position of FIG. 6C the locking part 30 with its locking protrusion 304 engages the locking protrusion 210 of the first closure member 2 in that the locking part 30 with its front face 307 has been moved into a U-shaped recess formed by the locking element 21, the locking protrusion 210 and the base 20. The locking part 30 herein has been moved into an engagement direction E into engagement with the U-shaped recess, wherein during the further closing movement and supported by the magnetic attraction between the magnet members 23, 33 the closure device 1 reaches its closed position shown in FIG. 7C in which the front face 307 faces the locking element 21 and the back face 308 faces the blocking element 24 on the base 20 of the first closure member 2.

Because the locking protrusions 210, 304 are rigidly arranged on the first closure member 2 respectively the second closure member 3, the closing movement is not a simple longitudinal movement, but involves different movements. In particular, the closure members 2, 3 for example in a first phase are approached to each other along a substantially linear closing direction X (see FIG. 2A). The second closure member 3 then however is tilted in a tilting direction X' (see FIG. 4C) in a first tilting orientation and then is tilted back in a tilting direction X" in a second tilting orientation (FIG. 5C) to reach the closed position of FIG. 7C.

In the closed position the second closure member 3 is held on the first closure member 2 in that the locking part 30 of the second closure member 3 is in a positive locking engagement with the locking element 21 carrying the locking protrusion 210 of the first closure member 2. The closure members 2, 3 herein furthermore are held on each other by means of the magnetic members 23, 33 such that an unintentional opening of the closure device 1 is prevented.

Because the force application element 31 in the shape of the bracket is attached to the locking part 30 of the second closure member 3 at the force application location 300 (see FIG. 7C), furthermore a not intended opening due to a large load acting onto the second closure member 3 is effectively prevented. Because the force application location 300 (which corresponds to the pivoting line of the force application element 31 in the shape of the bracket)—viewed along the engagement direction E—lies in between the front face 307 of the locking part 30 and a center 230 of the magnetic member 23 of the first closure member 2, forces introduced into the locking part 30 by means of the force application element 31 will, with a force component acting against the closing direction X, have a small leverage arm compared to the leverage arm of the magnetic attraction forces acting between the magnetic members 23, 33 such that even at large loads an opening of the closure device 1 by means of the loads are prevented.

Furthermore, because a displacement movement of the closure member 3 against the engagement direction E is prevented by means of the blocking element 24 rigidly arranged on the base 20 of the first closure member 2, loads can be introduced in virtually any direction into the second closure member 3 via the force application element 31 without the closure device 1 being opened due to the action of the loads. If loads for example act onto the second closure member 3 substantially in a direction against the engagement direction E, the locking part 30 with its back face 308 will come into abutment with the blocking element 24, such that the locking part 30 cannot be moved out of engagement from the locking element 21.

As a result, a high-strength closure device 1 is provided which in particular is suitable for example as a safety closure being capable of withstanding large loads. Furthermore, due to the simple construction of the closure device 1 the closure device 1 is easy to handle, reliable and not prone to dirt, making the closure device 1 suitable for a large variety of different applications in various environments under various conditions.

Figure 7B:
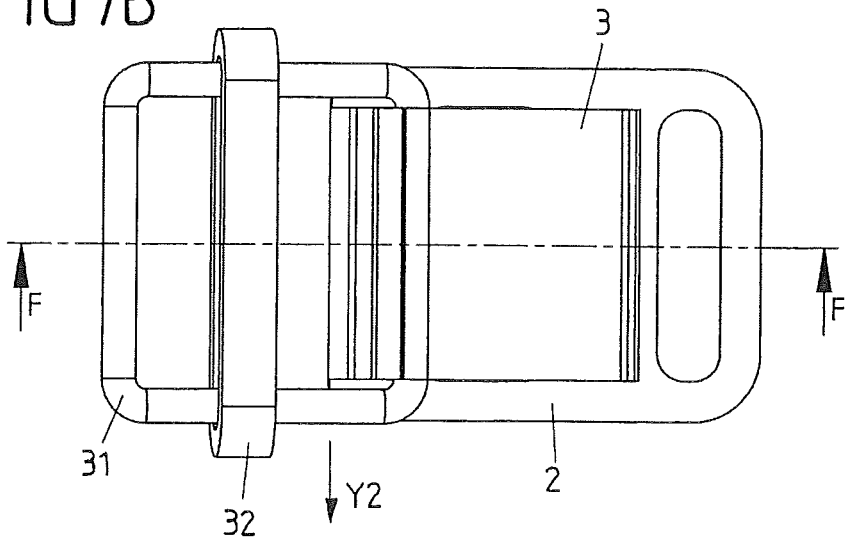
Figure 7C:
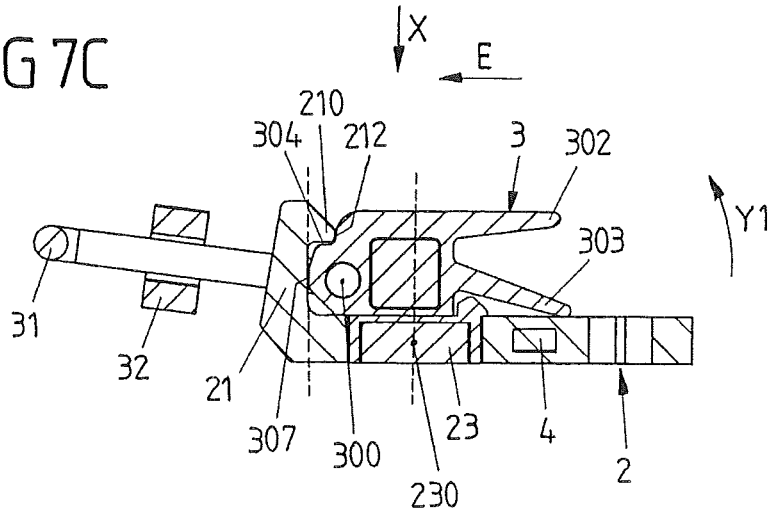

As shown in FIG. 7C, a magnetic field sensor 4 may be provided for example on the first closure member 2 (but just as well also on the second closure member 3) in order to obtain a feedback about the closure device 1 having reached its closed position. The magnetic field sensor 4 may for example be capable to sense the magnetic field strength of the magnet arrangement 23, 33 such that from the magnetic fields in the closed position of the closure device 1 it may be derived whether the closure device 1 correctly has reached its closed position or not. This may be indicated to a user for example by means of a light or an acoustic tone or in any other suitable manner.

For opening the closure device 1 a user may act on the handle 302 of the locking part 30 and may pivot the second closure member 3 in an opening direction Y1, as shown in FIG. 7C, in order to tilt the second closure member 3 and to bring it out of its locking relation with the blocking element 24. By tilting the second closure member 3 in that way, the magnetic members 23, 33 are removed from each other and the locking part 30 is tilted out of its engagement with the locking element 21, such that the second closure member 3 can be separated from the first closure member 2.

The handle 302 serves also as lever arm to allow an easy, smooth separation of the magnetic members 23, 33.

For an easy tilting movement the locking part 30 herein is rounded at a front edge facing the outer edge 212 of the locking protrusion 210 such that the locking part 30 with its rounded front edge can be slid past the outer edge 212 of the locking protrusion 210 when tilting the second closure member 3 for opening the closure device 1.

Furthermore, the closure device 1 may be opened by slidingly moving the second closure member 3 in an opening direction Y2, as this is indicated in FIG. 7B. For this, the force application element 31 in the shape of the bracket must be brought into a position in which it does not reach around the locking element 21, such that the second closure member 3 freely can be slid with its locking protrusion 304 along the locking protrusion 210 of the first closure member 2 until the second closure member 3 has come out of its engagement with the first closure member 2.

The locking part 30 of the second closure member 3 and the first closure member 2 may be manufactured from plastic or metal for example by extrusion. Such parts may in an easy manner be produced from extrusion profiles such that the fabrication is easy and cost effective.

In a modification of the previously described embodiment the force application element 31 in the shape of the bracket may also be rigidly attached to the locking part 30.

Figure 8A:
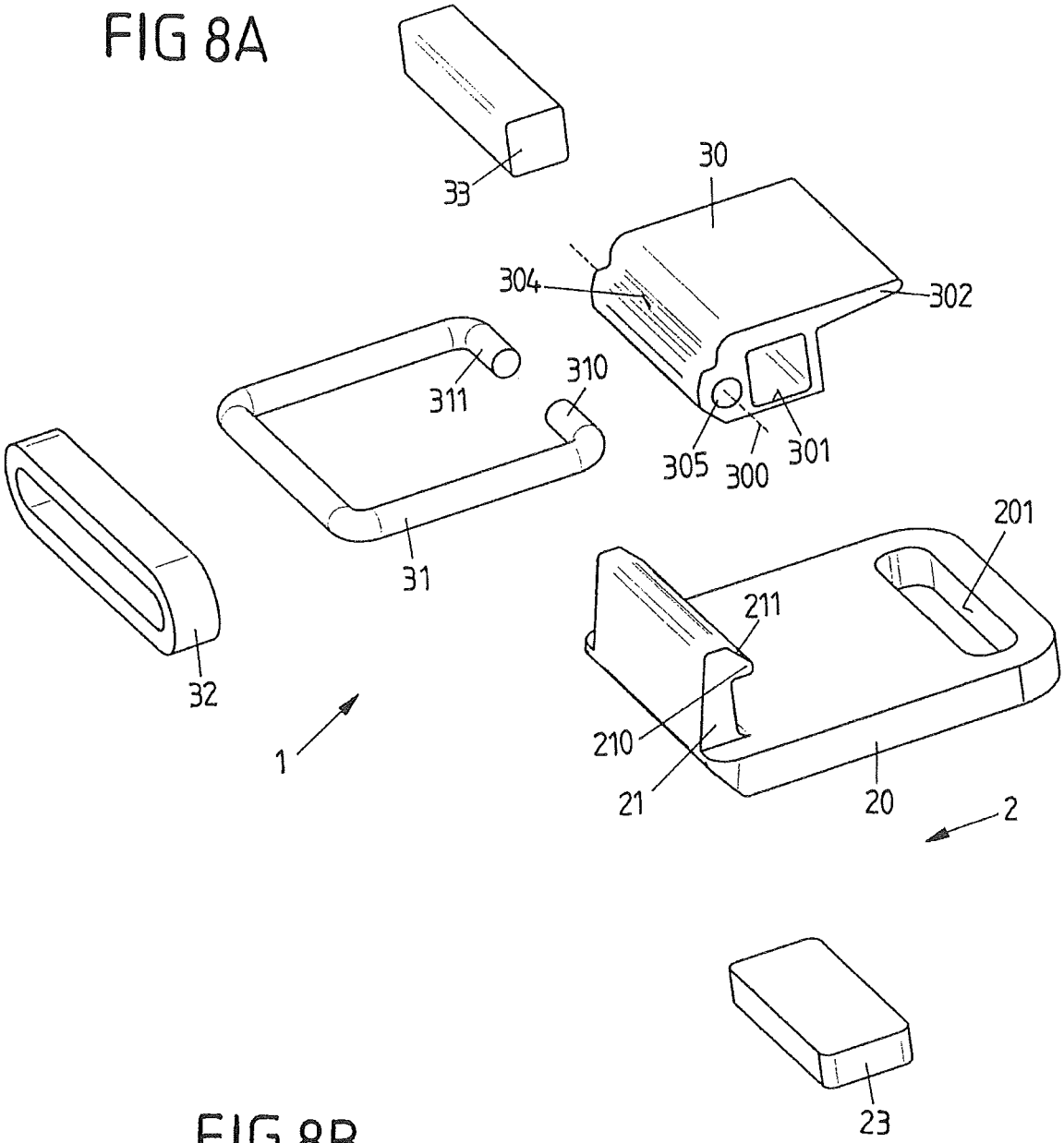
FIG. 8A shows a perspective explosive view of a second embodiment of a closure device.
Figure 8B:
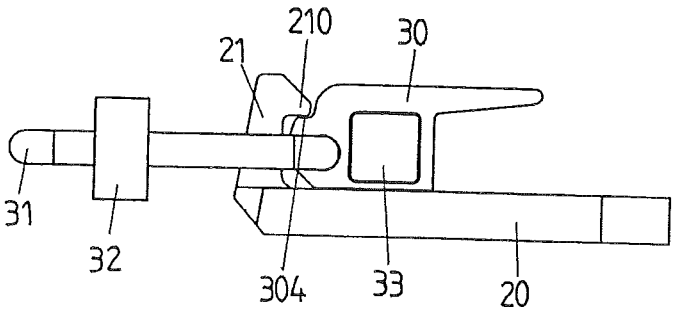
FIG. 8B shows a side view in a closed position of the closure device of FIG. 8A.

In another embodiment shown in FIGS. 8A, 8B, no blocking element 24 on the base 20 of the first closure member 2 is provided. Accordingly, the locking part 30 of the second closure member 3—in comparison to the previously described embodiment—does not have to comprise a support element 303 for preventing the second closure member 3 from becoming jammed in between the blocking element 24 and the locking protrusion 210 when closing the closure device 1. Other than that the embodiment of FIGS. 8A, 8B is identical to the previously described embodiment, such that it also shall be referred to the above.

Figure 9A:
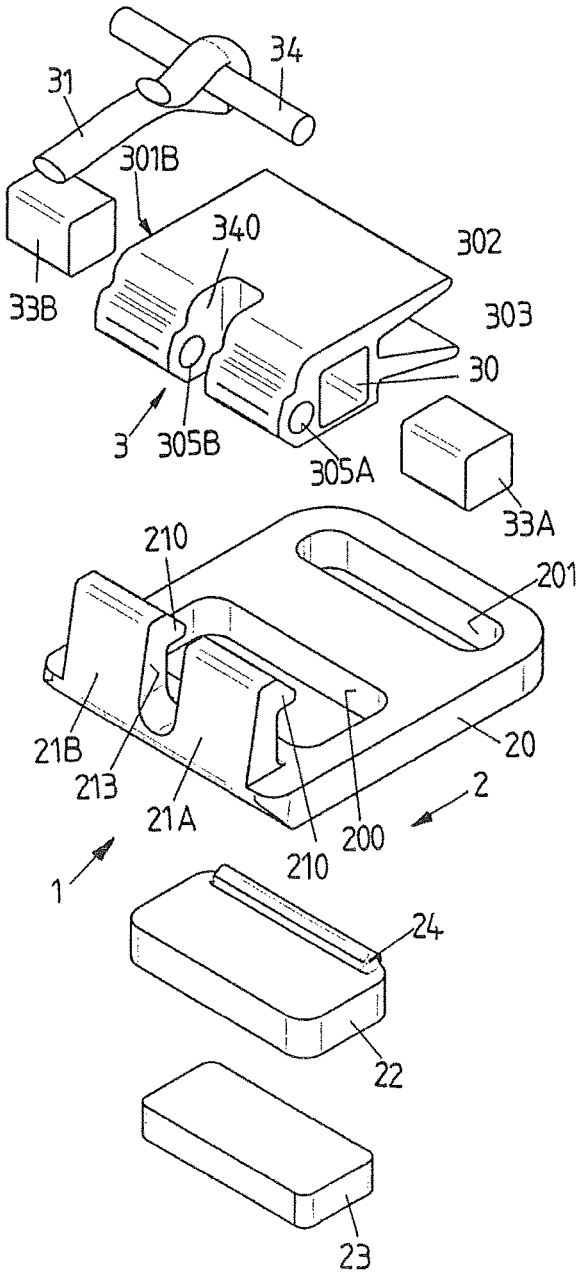
FIGS. 9A, 9B show perspective explosive views of another embodiment of a closure device.
Figure 9B:
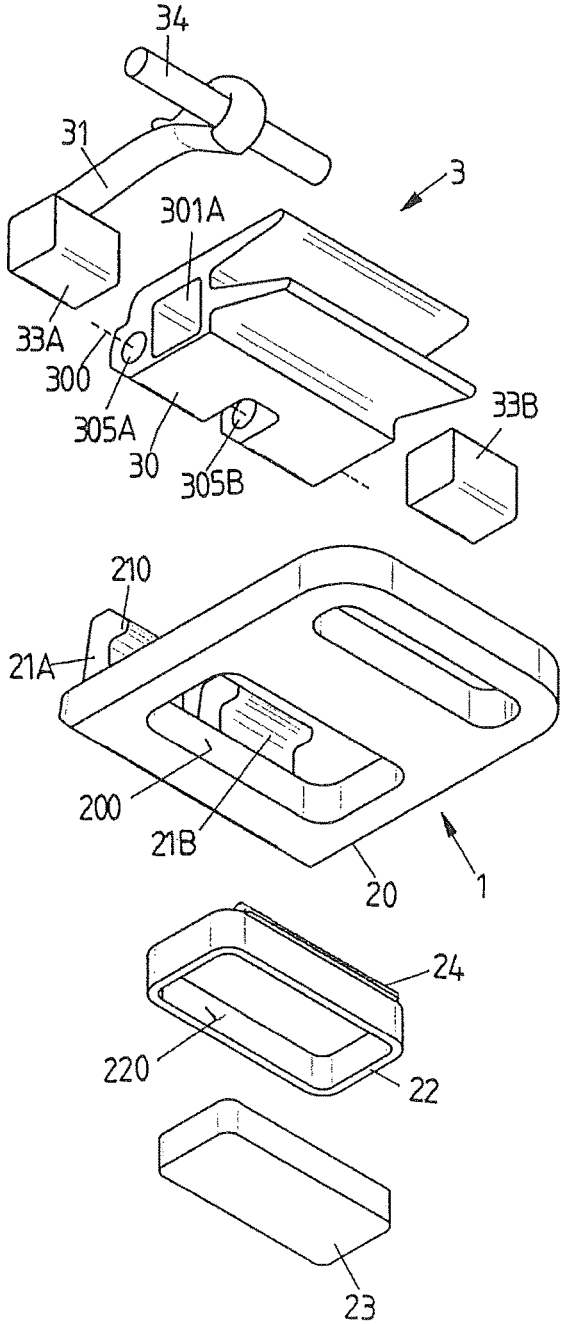
Figure 9C:
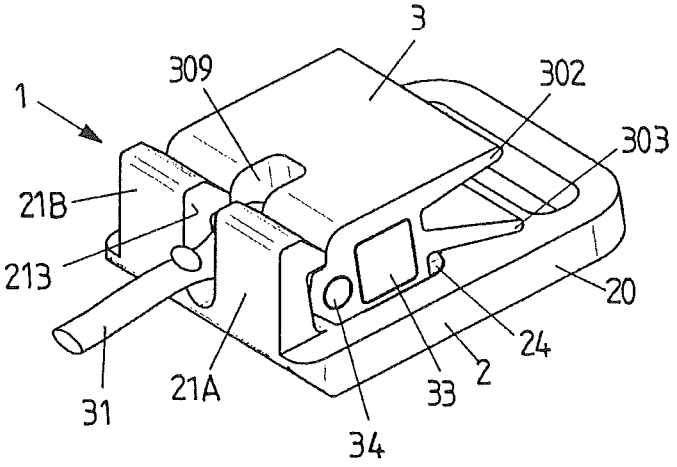
FIG. 9C shows a perspective view of the closure device in a closed position.
Figure 9D:
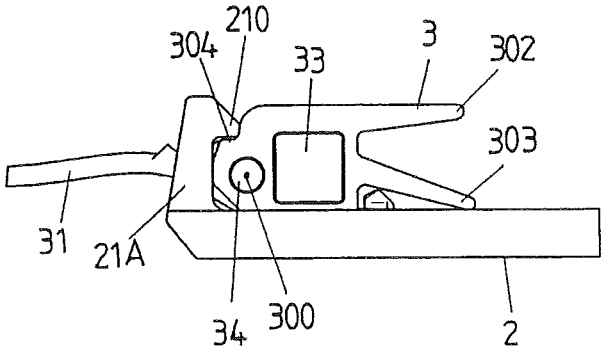
FIG. 9D shows a side view of the closure device.

In the embodiment of FIGS. 9A to 9D, a force application element 31 is provided in the shape of a wire, rope, chain, belt or the like which via an axis 34 is attached to the locking part 30 of the second closure member 3. The axis 34 herein is inserted into openings 305A, 305B of the locking part 30, wherein the force application element 31 is attached to the axis 34 at a location of a recess 340 on the locking part 30. In the closed position of the closure device 1 the force application element 31 reaches through the recess 340 of the locking part 30 and a recess 213 of the locking element 21 of the first closure member 3, as this is shown in FIG. 9C.

In the embodiment of FIGS. 9A to 9D, hence, the force application element 31 is pivotably attached to the locking part 30 via the axis 34. The force application element 31 hence acts onto a central point of the axis 34, via which forces are introduced into the locking part 30.

Due to the recess 340 being formed in the locking part 30, two magnetic members 33A, 33B are provided on the locking part 30, each received in an opening 301A, 301B in the locking part 30.

Other than that the functionality of the closure device 1 is similar to the embodiment of FIGS. 1A, 1B to 7A to 7C, such that it also shall be referred to the above description.

FIGS. 10A to 10D, 11A to 110, 12A to 12D, 13A to 13F, 14A to 14C, 15A to 15E, 16A to 16L, 17A to 17C, 18A to 18D and 19A to 19F show different embodiments of a closure device according to the present invention each also making use of several aspects of the previously described embodiments of FIGS. 1A to 9D. In particular, the engagement process of the two closure members 2 and 3 of a closure device 1 as outlined with respect to FIGS. 2A to 7C is similar in the embodiment shown in FIGS. 10A to 19F.

Similar to the embodiment of FIGS. 9A to 9D a closure device of, e.g., FIGS. 10A to 10D comprises two locking elements 21A and 21B spatially separated from each other at the base 20 of the first closure member 2. The two locking elements 21A and 21B are provided at different corner sections of the base 20. Each locking element 21A, 21B projects substantially perpendicular to the engagement direction E from the base 20. Between the two projecting locking element 21A and 21B a recess is provided so that a force application element in the form of a strap or belt 31 may extend from the second closure member 3 between the two locking elements 21A and 21B when the second closure member 3 is engaged with the first closure member 2 as intended.

Each of the locking elements 21A and 21B comprises a first locking protrusion 210 which may engage with a corresponding second locking protrusion 304 of the second closure member 3. The locking protrusions 304 of the second closure member 3 are provided at locking parts 30A and 30B of the second closure member 3 at different sides thereof. The first and second closure members 2 and 3 each comprise rigid first and second locking protrusions 210 and 304 as well as first and second magnetic members 23 and 33. Furthermore, the first closure member 2 comprises blocking elements 24A, 24B and the second closure member 3 comprises a support element 303 preventing an abutment of back faces 308 of the second closure member 3 with the respective blocking element 24A, 24B prior to an engagement of the second locking protrusions 304 of the second closure member 3 with the first locking protrusions 210 of the first closure member 2.

Spaced apart from the locking parts 30A and 30B and—with respect to the engagement direction E—located near the other end of the closure member 3 two lateral recesses 3030 are formed in the support element 303. During the engagement process of the two closure members 2 and 3 the projecting blocking elements 24A and 24B each interact with one of the lateral recesses 3030 so that the second closure member 3 is guided along the two blocking elements 24A and 24B. Thereby, an abutment of back faces 308 each located on a side wall of the respective lateral recess 3030 with the blocking element 24A or 24B is prevented until the second locking protrusions 304 engage the first locking protrusions 210.

The base 20 of the first closure member 2 furthermore comprises two belt receptacles 201A and 201B at—viewed along the engagement direction E—a front and a rear portion of the base 20. By means of the belt receptacles 201A, 201B the first closure member 2 may be attached to a strap- or belt-like part.

The second closure member 3 comprises a middle portion constituting a buckle element at which the strap or belt 31 is adjustably attached in a form-fitting and force-fitting manner. The middle portion of the second closure member 3 therefor comprises a tunnel 305 through which an end 310 of the strap or belt 31 extends. As can in particular be seen from the sectional view of FIG. 100 the strap or belt 31 is guided via the tunnel 305 completely through the second closure member 3 along the engagement direction E and past the second magnetic member 33 of the second closure member 3 as well as past the two lateral recesses 21A and 21B. Since the tunnel 305 does not extend rectilinearly within the middle portion of the second closure member 3 the end 310 of the strap or belt 31 is deflected several times within the tunnel 305 and is held therein in a force fitting manner. In this way, the strap or belt 31 is adjustably attached to the second closure member 3. The length of the strap or belt 31 may thus be easily adjusted by just pulling the belt or strap 31 when no loads act onto the closure device 1 and/or the second closure member 3 is not yet attached to the first closure member 2, thereby sliding the belt or strap 31 along the tunnel 305 in the one of the other direction.

Figure 11C:
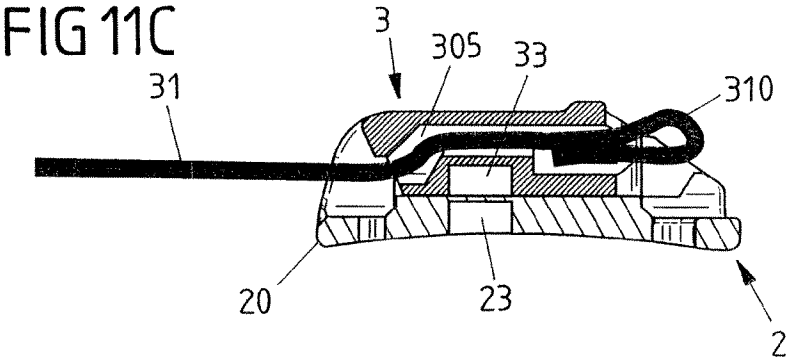
FIGS. 11A-11C show a modified embodiment of a closure device according to the invention in three different views.
Figure 11B:
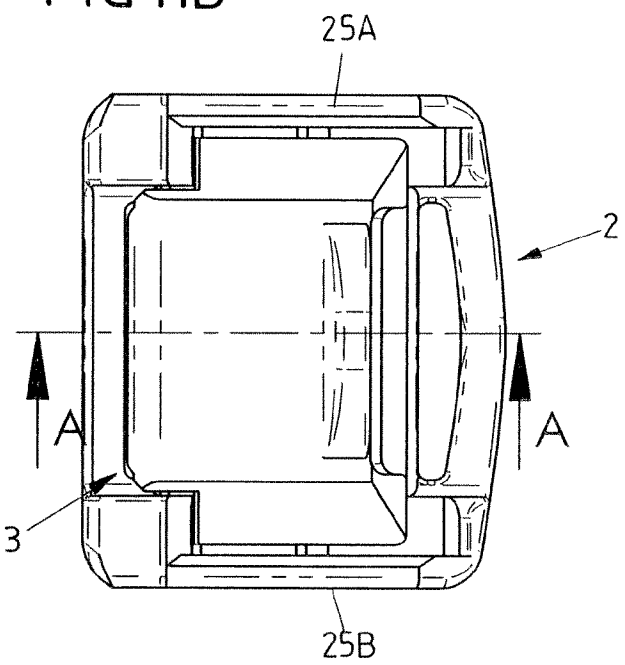
Figure 11A:
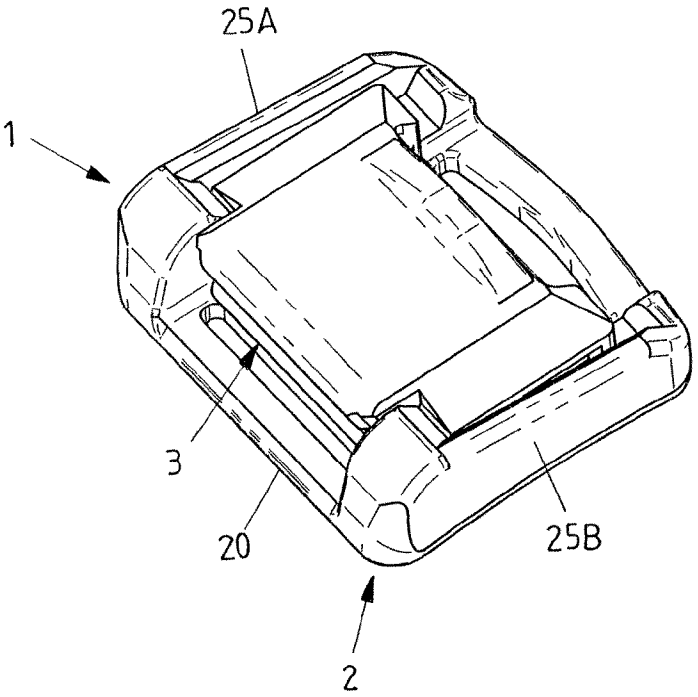
Figure 12C:
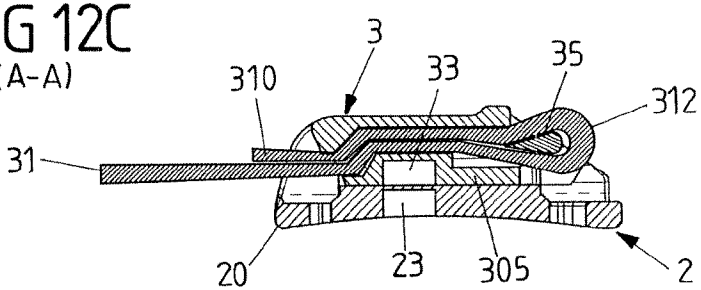
FIGS. 12A-12D show a further embodiment of a closure device according to the invention based on the embodiment of FIGS. 11A-11C and including a wedge-element.
Figure 12B:
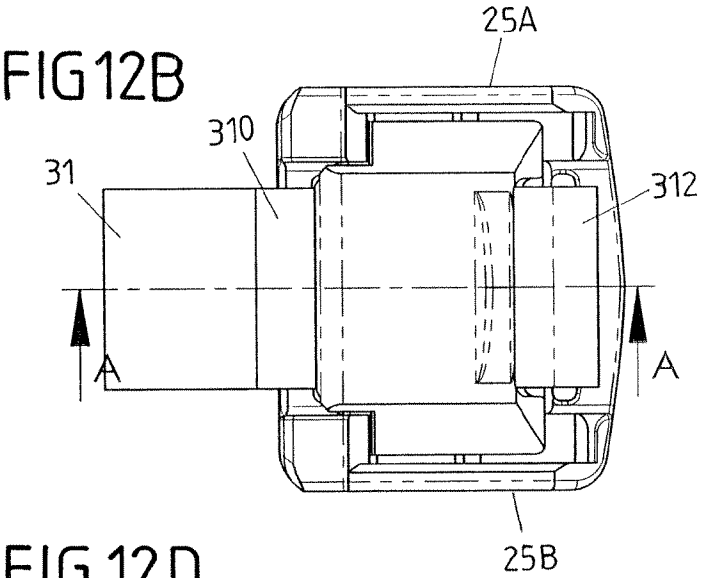
Figure 12D:
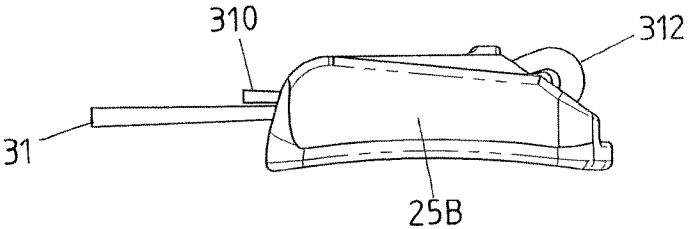
Figure 12A:
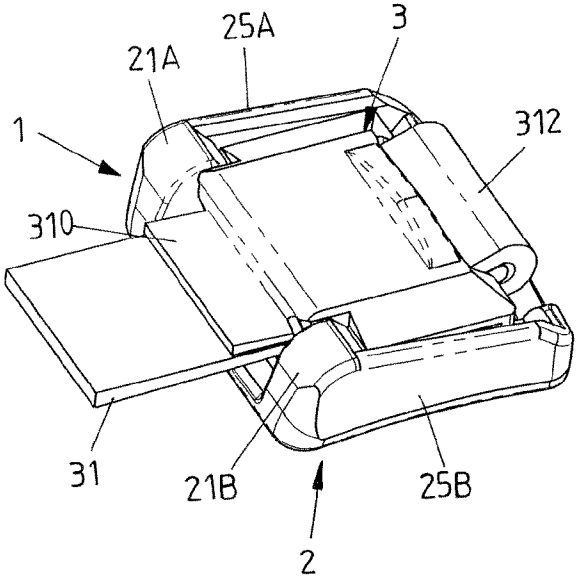
Figure 13C:
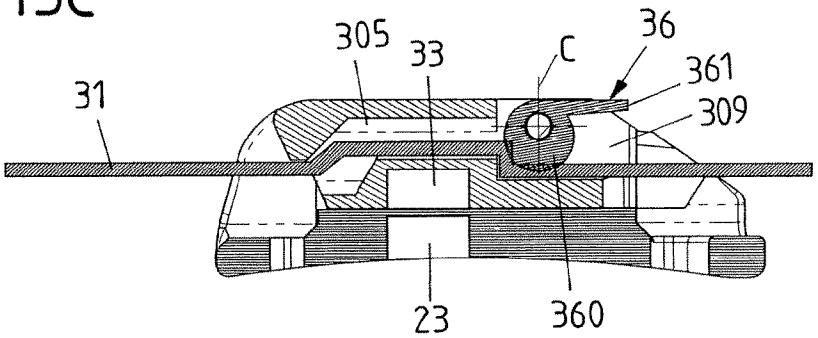
FIGS. 13A-13F show, in different views and states of a clamp element, a further embodiment of a closure device according to the invention comprising the clamp element for adjustably attaching a strap or belt to second closure member of the closure device.
Figure 13B:
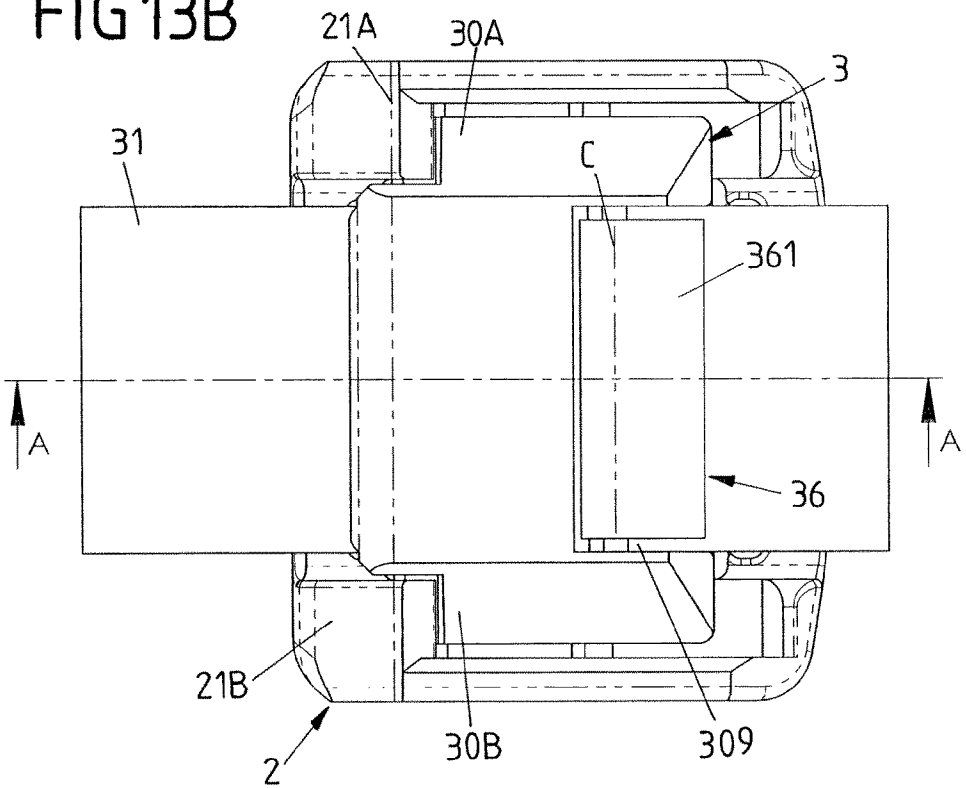
Figure 13A:
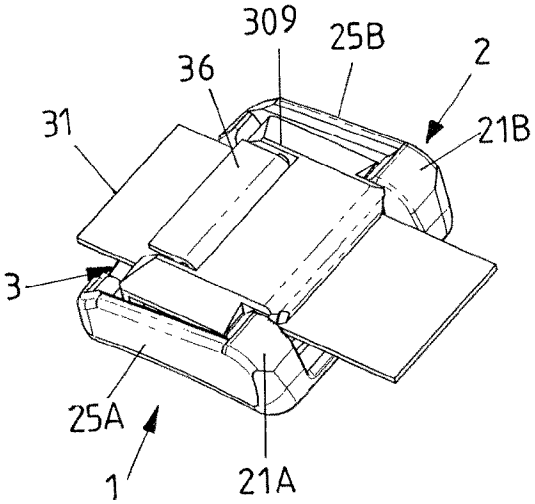
Figure 13F:
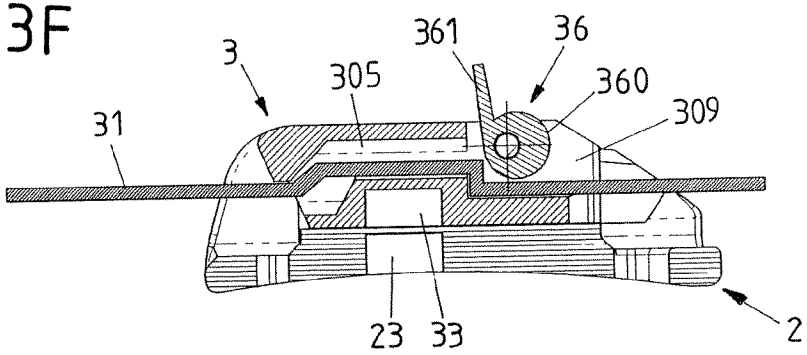
Figure 13E:
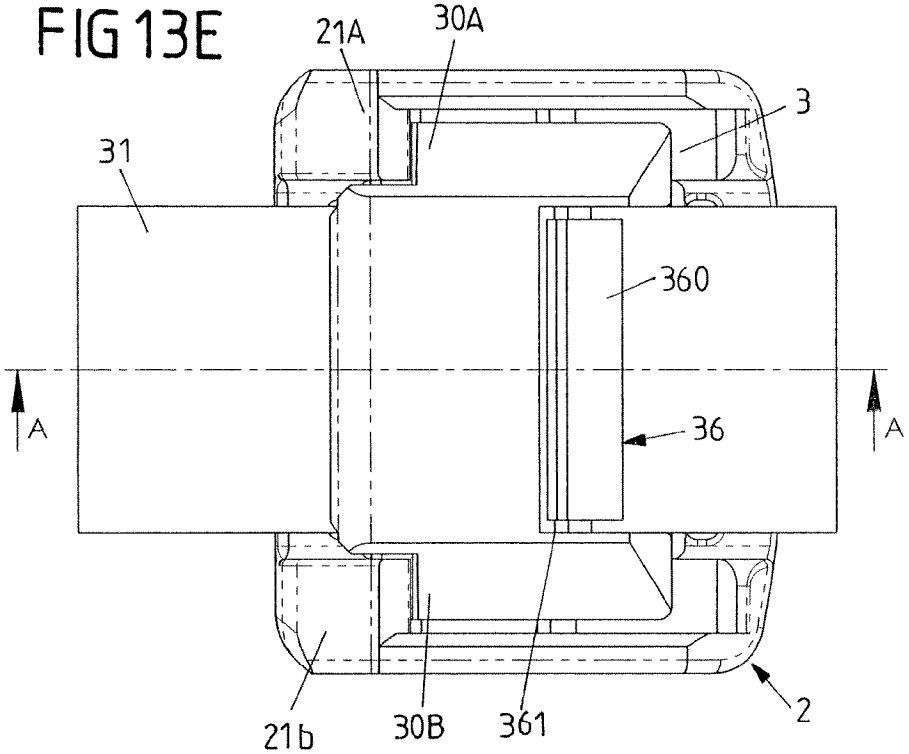
Figure 13D:
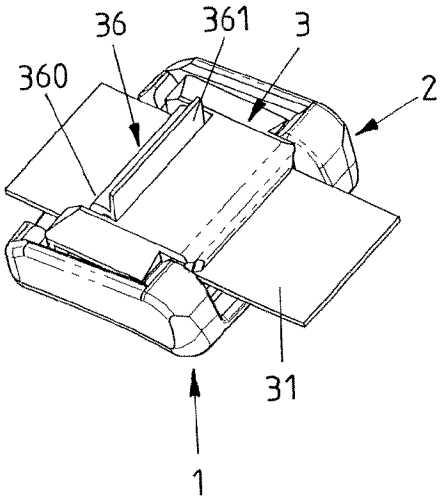
Figure 14D:
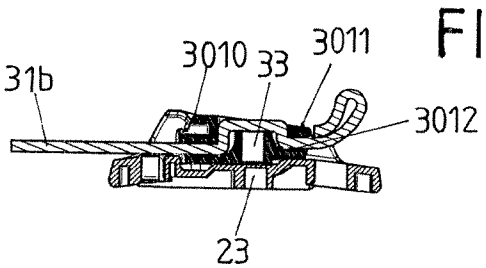
Figure 14D:
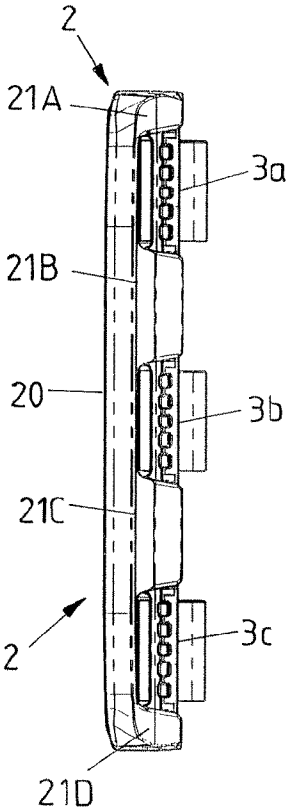
Figure 14B:
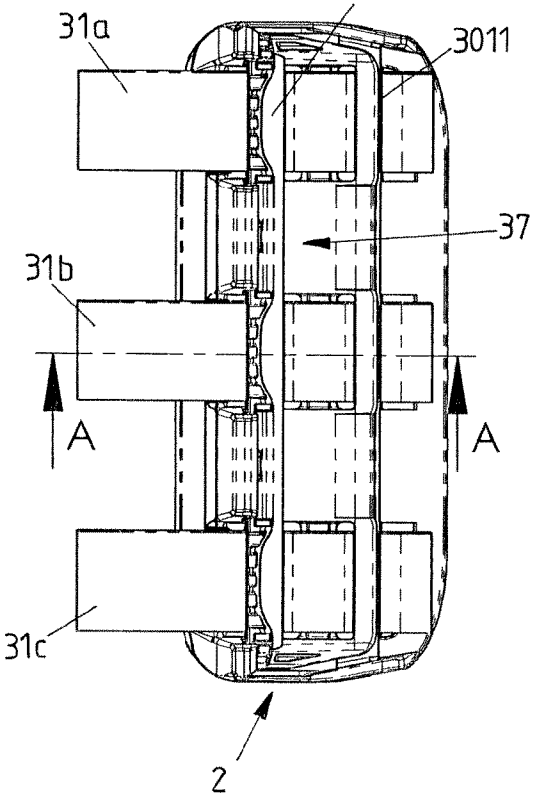
Figure 14A:
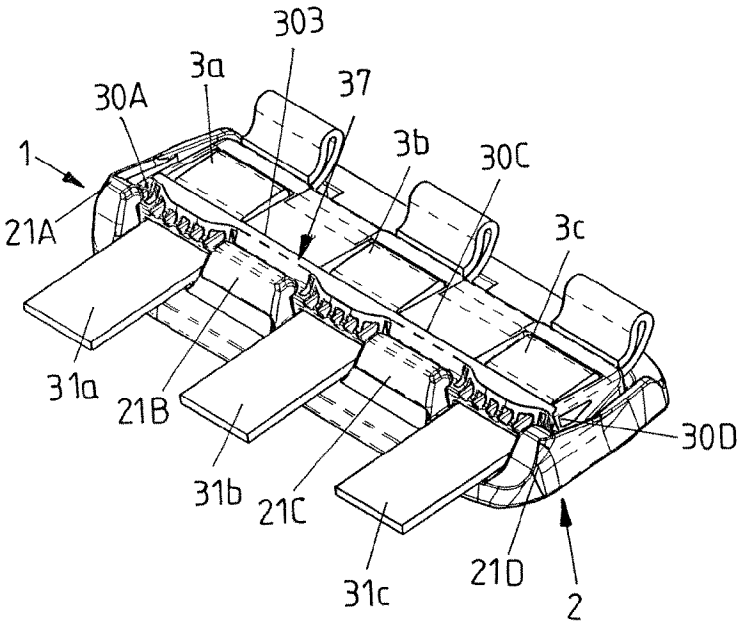
Figure 15E:
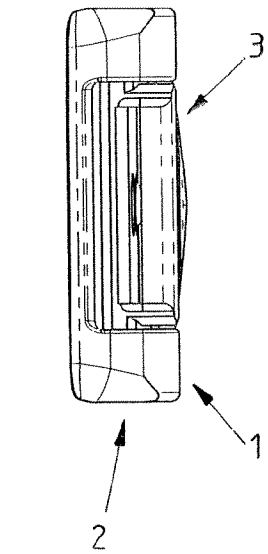
FIGS. 15A-15E show different view of further embodiment of a closure device according to the invention and comprising a second closure member with a form-fit element for adjustably attaching a strap or belt to the second closure member.
Figure 15C:
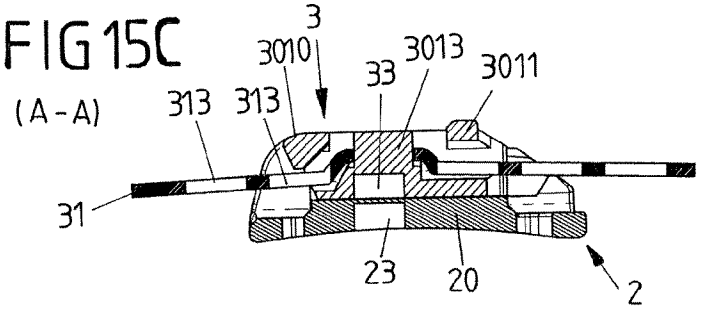
Figure 15B:
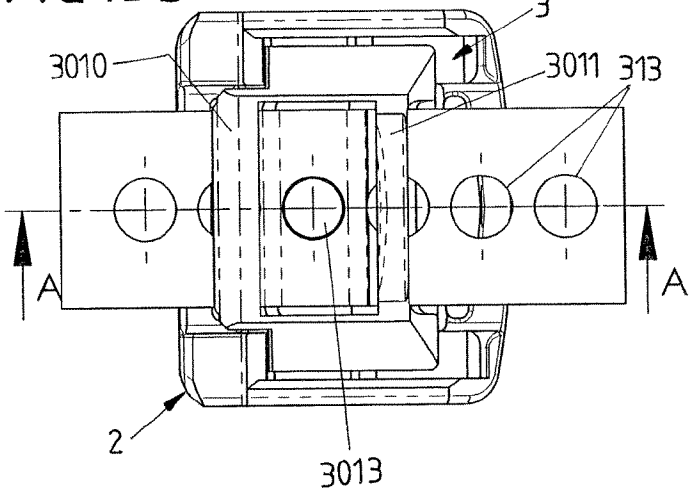
Figure 15D:
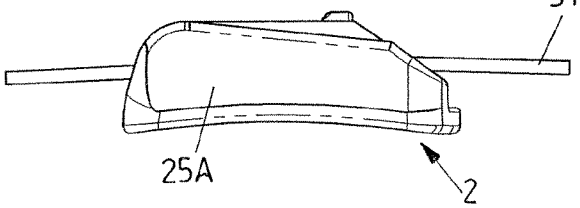
Figure 15A:
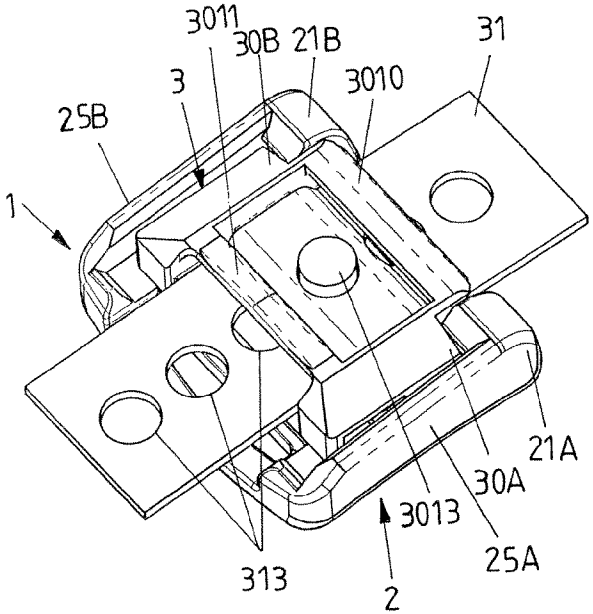
Figure 16A:
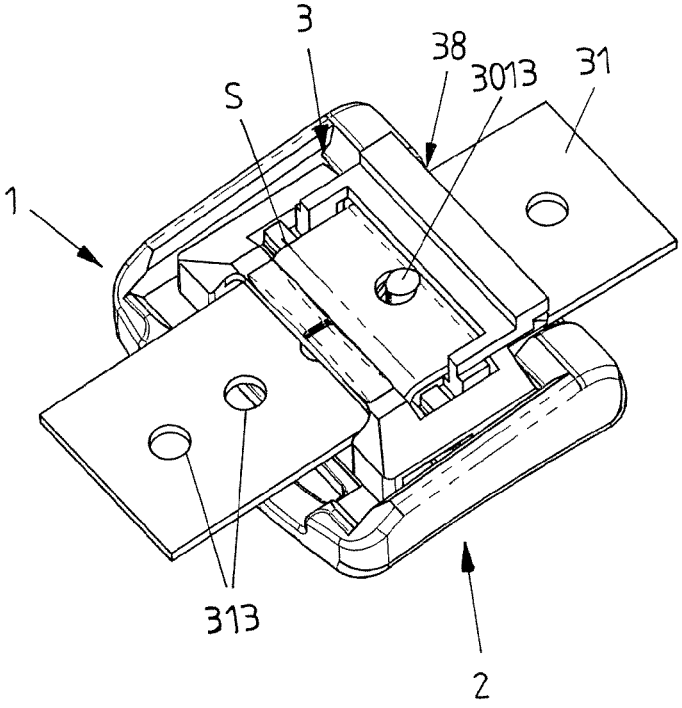
Figure 16D:
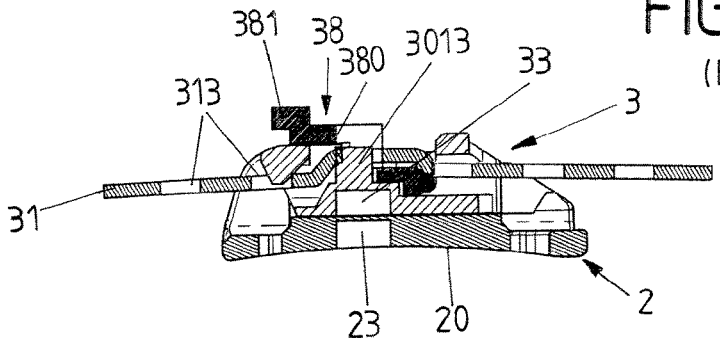
Figure 16C:
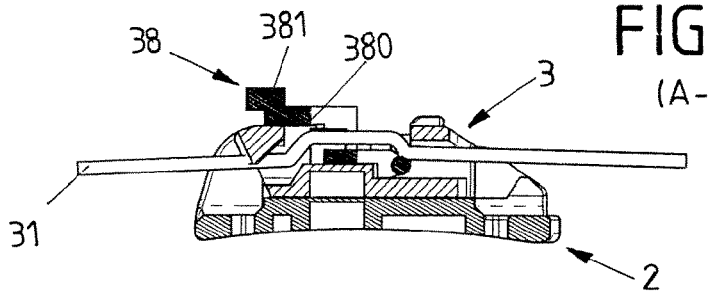
Figure 16B:
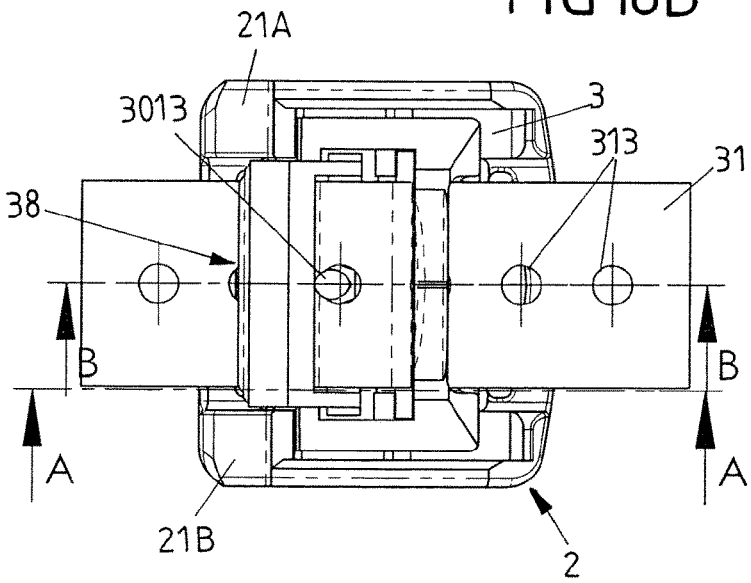
Figure 16F:
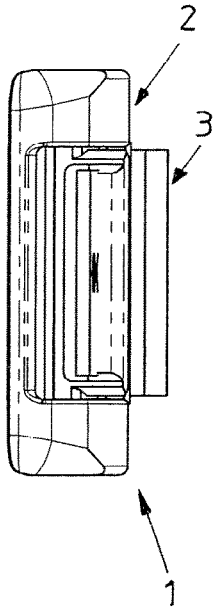
Figure 16E:
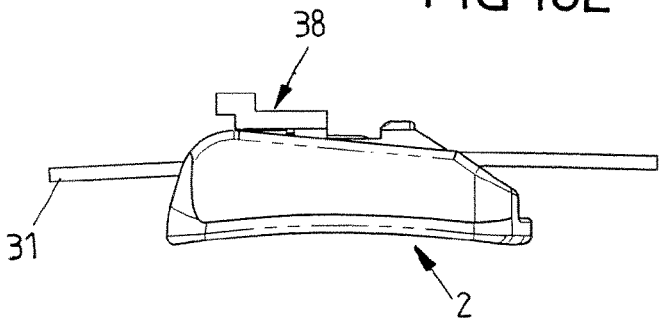
Figure 16G:
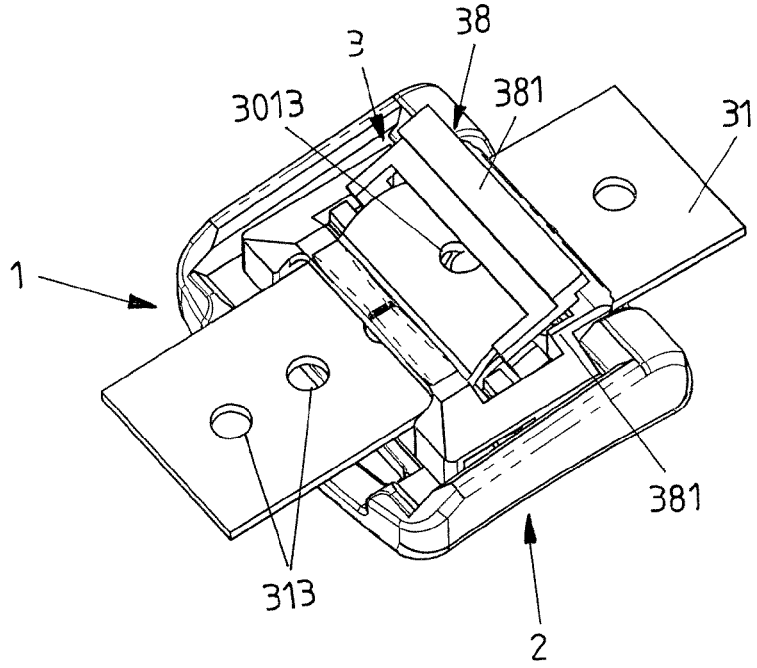
FIGS. 16G-16L show identical view of the embodiment of FIGS. 16A-16F with the securing element in its open state.
Figure 16J:
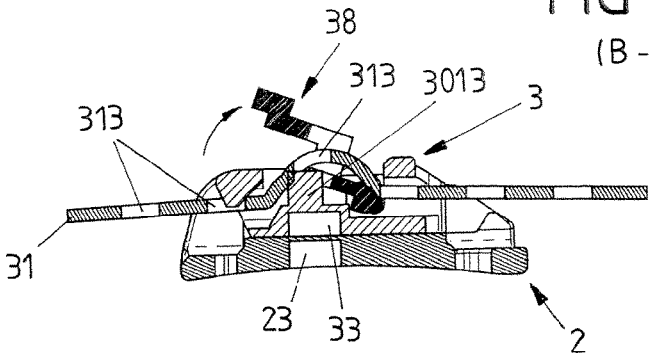
Figure 16I:
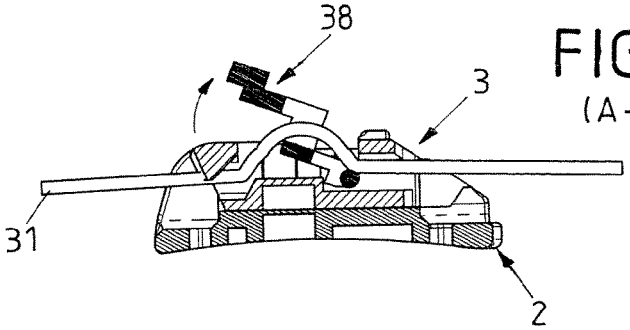
Figure 16H:
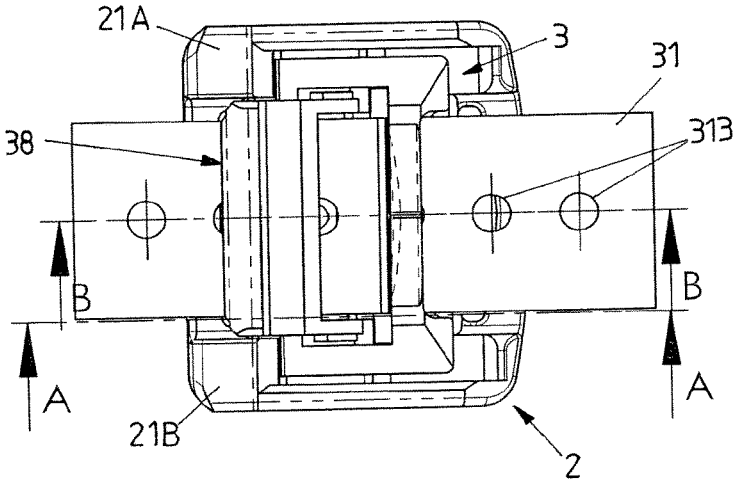
Figure 16L:
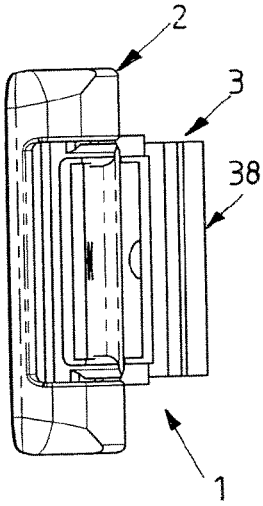
Figure 16K:
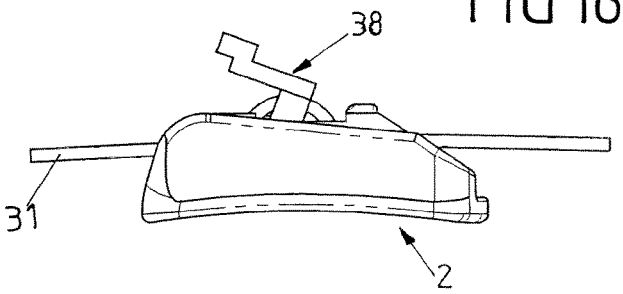

The embodiment of FIGS. 11A to 110 is based on the embodiment of FIGS. 10A to 10D and includes a first closure member 2 which is provided with two side walls 25A and 25B. These side walls 25A and 25B substantially extend parallel to the engagement direction E and laterally cover the blocking elements 24A and 24B as well as the lateral recesses 3030 of the second closure member 3 when it is attached as intended to the first closure member 2.

By means of the side walls 25A and 25B an unintentional disengagement of the first and second closure members 2 and 3 is further prevented. When attached to the first closure member 2 the second closure member 3 may thus be just grasped at a rear portion. From a lateral side no force may be unintentionally applied to the second closure member 3 which would disengage the two closure members 2 and 3.

FIGS. 12A to 12D show a modification of the embodiment of FIGS. 11A to 110 in which an additional wedge element 35 is provided at the strap or belt 31 in order to prevent the strap or belt 31 to unintentionally slide through the tunnel 305 of the second closure member 3.

Herein, the end 310 of the strap or belt 31 is wound once around the wedge element 35 and forms a loop section 312 around the wedge element 35 so that two overlaying sections of the strap or belt 31 extend through the tunnel 305 with the wedge element 35 preventing the loop section 312 from being pulled or pushed into the tunnel 305. For example, for attaching the strap or belt 31 to the second closure member 3 the end 310 of the strap or belt 31 is firstly guided through the tunnel 305 in a first direction (opposite to the engagement direction E). Afterwards it is wound around the wedge element 35 so that the strap or belt 31 is deflected about 180°. Then, the end 310 is guided again through the tunnel 305 in a second direction opposite the first direction.

The preferably elongated wedge element 35 may be rigidly provided at a rear portion of the second closure member 3 or it may be provided as a separate member just attached to the strap or belt 31 for constituting the loop section 312.

FIGS. 13A to 13F illustrate a further embodiment according to the invention in which a strap or belt 31 is adjustably attached to the second closure member with the aid of a clamp element 36. The clamp element 36 is pivotable about an axis C at the second closure member 3 between a closed state shown in FIGS. 13A to 13C and an open state shown in FIGS. 13D to 13F.

The clamp element 36 comprises an excentric clamp body 360 and a handle 361 by means of which the clamp element 36 may be manually moved from one state to the other. In a closed state the excentric clamp body 360 presses a section of the strap or belt 31 extending through the tunnel 305 against a wall portion of the closure member 3 so that the strap or belt 31 is fixed in its position relative to the closure member 3. The clamp element 36 here clamps a section of the strap or belt 31 in a force- and form-fitting manner to the closure member 3.

When the clamp element 36 is moved to an open state its excentric clamp body 360 no longer clamps the strap or belt 31. The strap or belt 31 may hence be adjusted in its length by pulling it through the tunnel 305. In order to secure the strap or belt 31 then in a desired length the clamp element 36 is just manually pushed again to the closed state via its handle 361.

In FIGS. 14A to 14D different views of a further embodiment of a closure device 1 are shown in which a first closure member 2 defines several (here three) attachment sections for several closure members 3*a*, 3*b* and 3*c*. Each of the different second closure members 3*a*, 3*b* and 3*c* may be attached to the first closure member 2. The attachment of the respective second closure members 3*a*, 3*b* and 3*c* to the single first closure member 2 is similar to the previously described pairs of a single second closure member 3 and a single first closure member 2.

The base 20 of the first closure member 2 of the embodiment of FIGS. 14A to 14D has several locking elements 21A, 21B, 21C and 21D arranged next to each other. A locking element 21A, 21B, 21C, 21D is spaced apart from the next locking element 21B, 21A, 21C or 21D by a recess for a strap or belt 31*a*, 31*b*, 31*c* of a second closure member 3*a*, 3*b* or 3*c*. Accordingly, pairs of locking elements 21A/21B, 21B/21C, and 21C/21D are provided at the base 20 of the first closure member 2 of FIGS. 14A to 14D for engagement with locking parts 30A, 30B, 30C and 30D of the second closure members 3*a*, 3*b* and 3*c*.

The strap or belt 31*a*, 31*b*, 31*c* is attached to the respective second closure member 3*a*, 3*b* or 3*c* in a similar way as already described with regard to FIGS. 11A to 11C. In contrast, however, a section of the strap or belt 31*a*, 31*b* or 31*c* is not completely enclosed in the middle portion of the respective second closure member 3*a*, 3*b* or 3*c* but is visible from the outside between two bars of the second closure member 3*a*, 3*b* or 3*c*; namely a front bar 3010 and a rear bar 3011. Due to the deflection of the strap or belt 31*a*, 31*b* or 31*c* between the two bars 3010 and 3011 at a deflecting protrusion 3012 the strap or belt 31*a*, 31*b* or 31*c* is nevertheless adjustably and securely attached to the second closure member 3*a*, 3*b* or 3*c*. Each second closure member 3*a*, 3*b* or 3*c* here thus also constitutes a ladderlock or buckle element for the strap or belt 31*a*, 31*b* or 31*c*. Furthermore, it has to be noted that, of course, a design of the second closure members 3*a*, 3*b* and 3*c* may also be applied as described with regard to a second closure member 3 of FIGS. 10A to 10D, 12A to 12D, 13A to 13F or the later described FIGS. 15A to 15E and 16A to 16L.

In the embodiment of FIGS. 14A to 14D the second closure members 3*a*, 3*b* and 3*c* are furthermore coupled with each other by an elongated coupling element 37. This coupling element 37 is partially formed by the locking parts 30A, 30B, 30C and 30D and the respective front bar 3010 of the second closure members 3*a*, 3*b* and 3*c*. The coupling element 37 substantially extends perpendicular to the engagement direction E. The coupling element 37 rigidly connects the three second closure members 3*a*, 3*b* and 3*c* with each other so that a movement of one of the second closure members 3*a*, 3*b* or 3*c* also affects the other second closure members. Consequently, a user may just disengage one of the second closure members 3*a*, 3*b* or 3*c* from the first closure member 2 and pull at it in order to effect a simultaneous detachment of the other second closure members from the first closure member 2.

In FIGS. 15A to 15E and 16A to 16L two further embodiments of a closure device 1 with a single first closure member 2 and a single second closure member 3 are illustrated. Herein, a strap or belt 31 is adjustably attached to the second closure member 3 by a buckle-like middle portion of the second closure member 3 having a protruding form-fit 3013 element which may selectively engage in of several holes 313 of the strap or belt 31.

In the closure device of FIGS. 15A to 15E a single protruding form-fit element 3013 in the form a cylindrical pin is provided between a front and a rear bar 3010, 3011 at the second closure member 3. When adjusting the strap or belt 31 it is slideably guided by the front and rear bars 3010 and 3011 at the second closure member 3. The strap or belt 31 may be arrested at the second closure member 3 by the form-fit element 3013 reaching through a hole 313 of the strap or belt 31. The strap or belt 31 comprises several through-holes 313 arranged one behind the other so that a length of the strap or belt 31 may be gradually adjusted.

Compared to the embodiment of FIGS. 15A to 15E the closure device 1 of FIGS. 16A to 16L is additionally provided with a securing element 38 for securing the engagement of a form-fit element 3013 with a hole 313 of the strap or belt 31. The securing element 38 may be swiveled between at least one open and a closed state at the second closure member 3. The engagement of the form-fit element 3013 in one of the holes 313 of the strap or belt 31 is secured by the securing element 38 in its closed state, whereas the strap or belt 31 may be disengaged from the form-fit element 3013 in an open state of the securing element 38 in order to adjust its length. FIGS. 16A to 16F show the securing element 38 in its closed state. FIGS. 16G to 16L in identical views show the securing element 38 in its open state.

As can be clearly depicted from the drawings, the securing element 38 comprises a handle 381 to that it may be easily opened and closed by hand. Furthermore, the securing element 38 comprises a securing body 380 blocking a displacement of the strap or belt section which is attached to the second closure member 3 in a positively locking manner by the form-fit element 3013 reaching through a hole 313 of this section. The swivel axis of the securing element 38 is defined via two support arms of the securing element 38 between which the strap or belt 31 extends. When the securing element 38 is swiveled (upwards) about its swivel axis to the open state the engaging section of the strap or belt 31 may be displaced perpendicular to its direction of extent in order to remove it from the form-fit element 3013 and adjust the length of the strap or belt 31.

The embodiments of a closure device 1 according to the invention as shown in FIGS. 17A to 17C, 18A to 18D and 19A to 19F each comprise several pairs of first and second closure members 2*a*/3*a*, 2*b*/3*b*, 2*c*/3*c* and 2*d*/3*d* which are coupled with each other by means of one at least partially flexible coupling element 5 and/or 6.

Figure 17C:
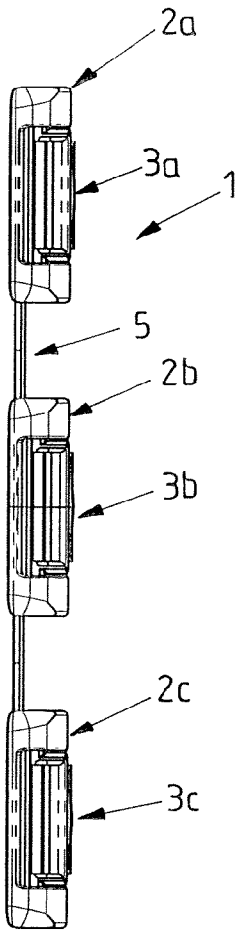
FIGS. 17A-17C show a further embodiment of a closure device comprising several pairs of first and second closure devices coupled with each other by a flexible coupling elements being connected to the second closure members.
Figure 17B:
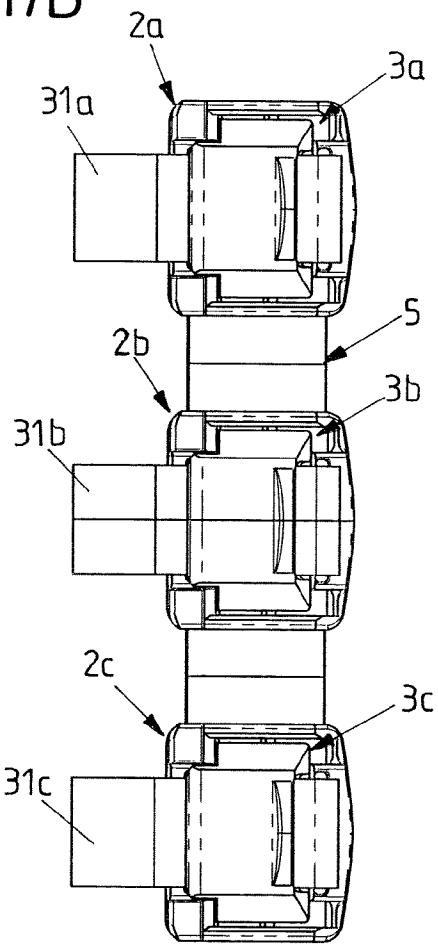
Figure 17A:
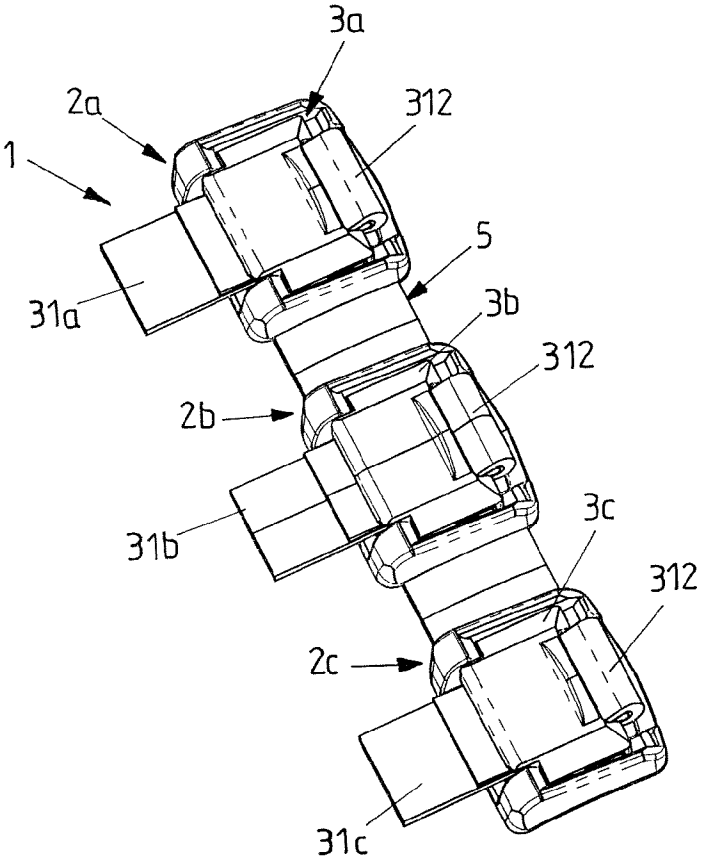
Figure 18D:
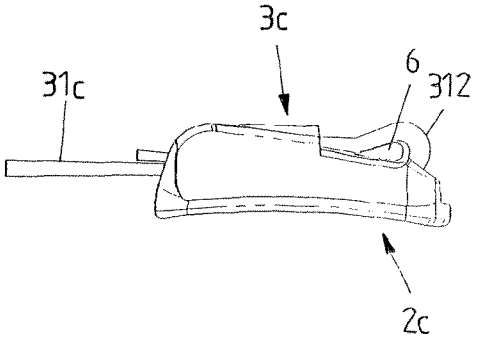
FIGS. 18A-18D show a modified closure device based on the embodiment of FIGS. 17A-17C in which the first closure members are coupled with each other as well by a second coupling element.
Figure 18C:
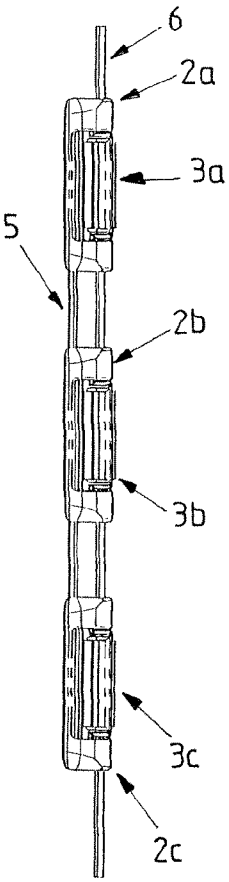
Figure 18B:
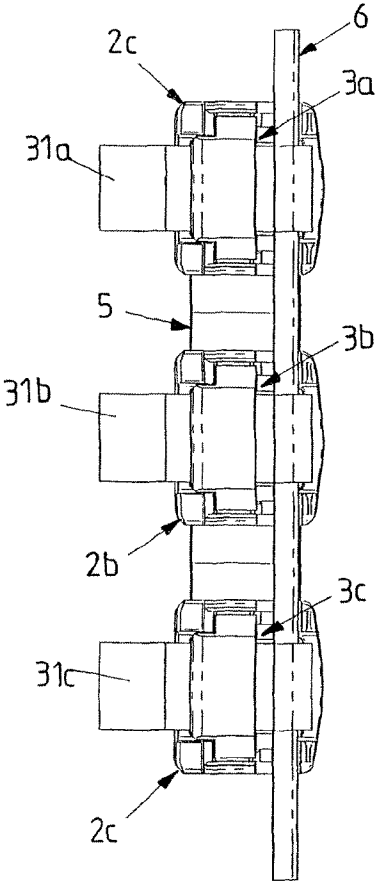
Figure 18A:
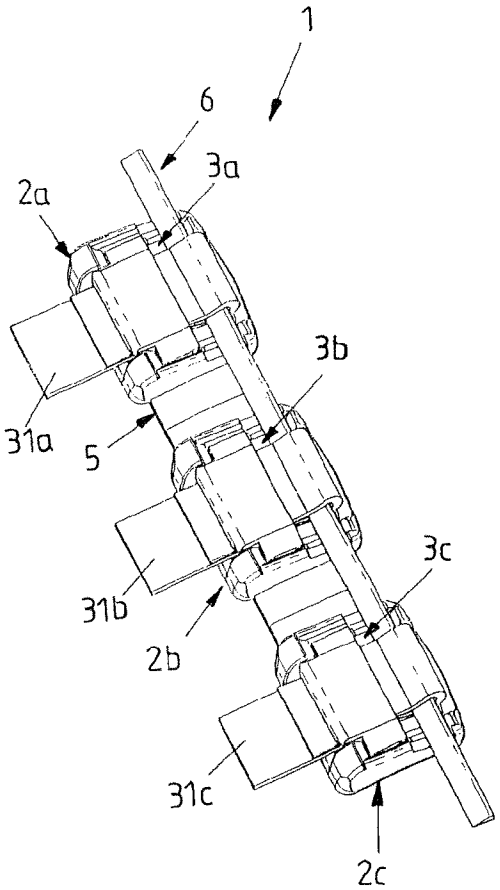
Figure 19D:
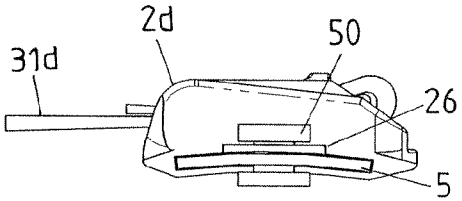
FIGS. 19A-19F show different views of a further embodiment of a closure device according to the invention in which several pairs of first and second closure member are fastened to a single coupling element.
Figure 19C:
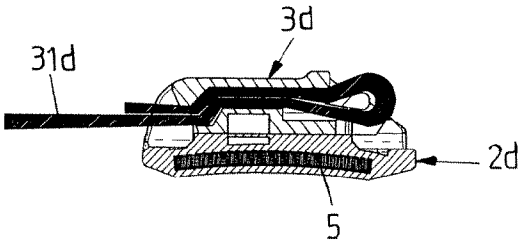
Figure 19B:
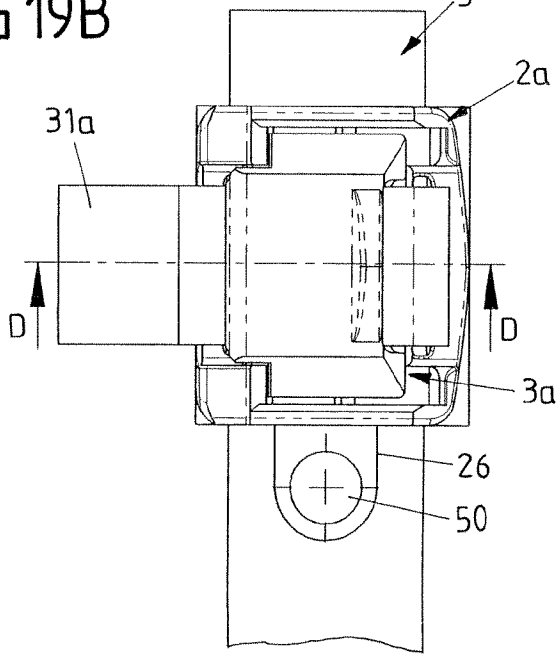
Figure 19A:
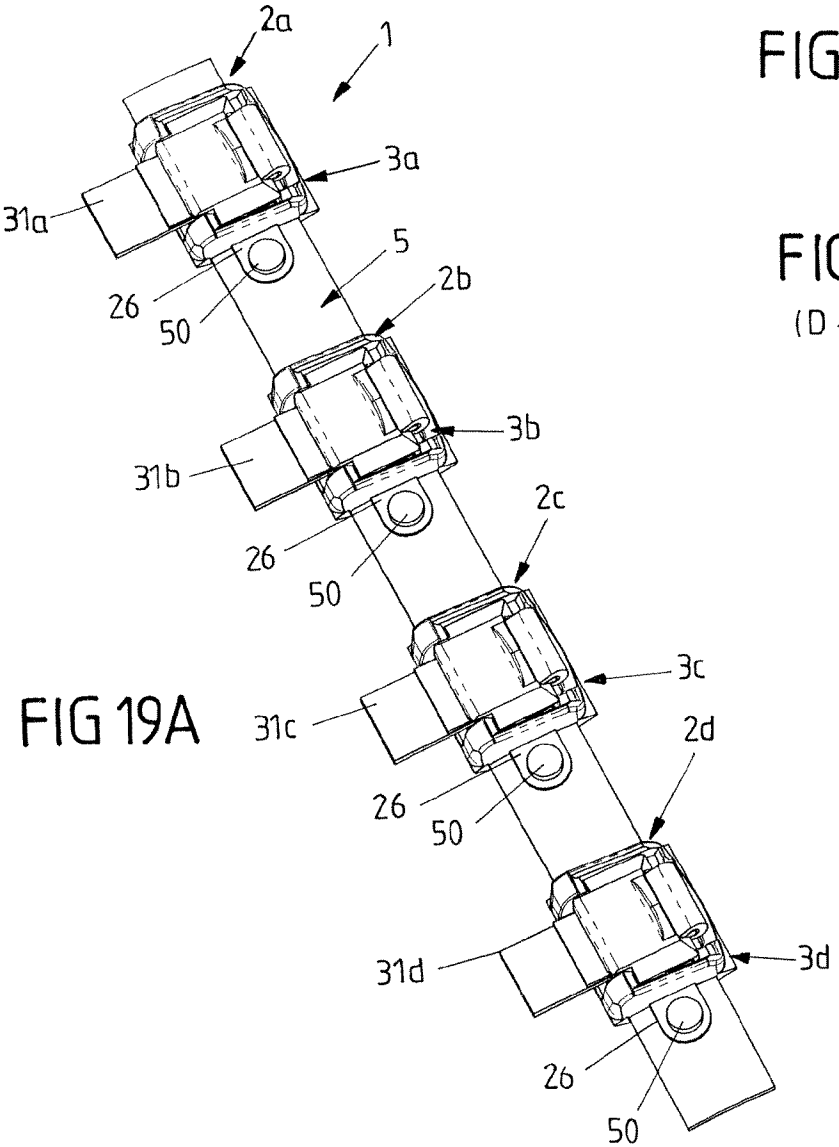
Figure 19E:
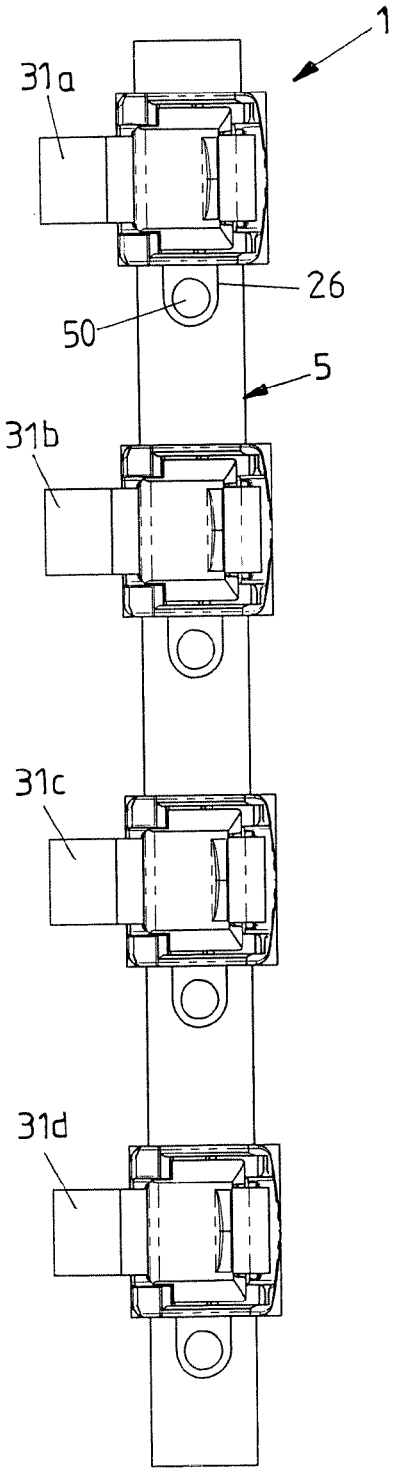
Figure 19F:
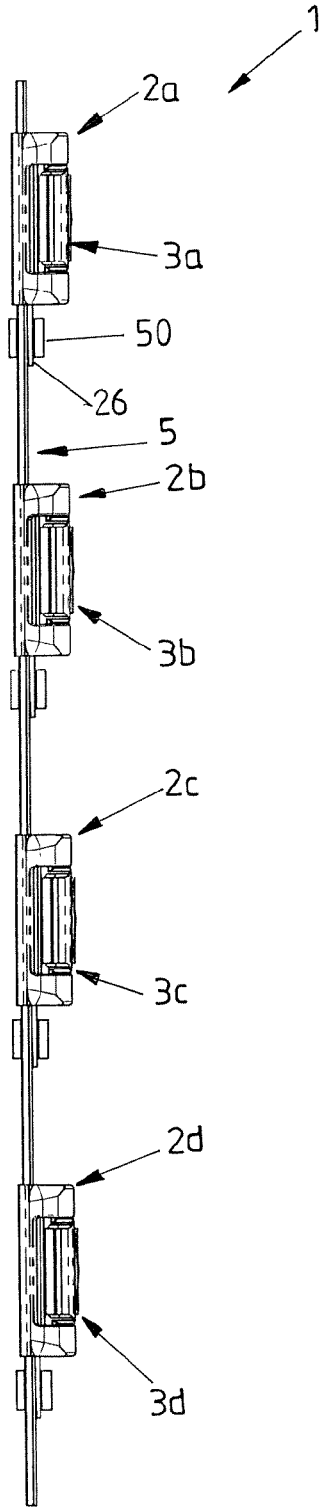

The closure device 1 of FIGS. 17A to 17C comprises several first and second closure members 2*a* to 2*c* and 3*a* to 3*c* of which the first closure members 2*a*, 2*b* and 2*c* are arranged next to each other and coupled via a flexible coupling element 5 in the form a strap or belt. The coupling element 5 is in each case rigidly attached to a first closure member 2*a*, 2*b* or 2*c*. For example the coupling element 5 may be molded to the first closure members 2*a* to 2*c* or the first closure members 2*a* to 2*c* may be molded in such a way that the coupling element (made of a different material) is embedded in the material of the first closure members 2*a* to 2*c*. In another embodiment the first closure members 2*a* to 2*c* may be releasably and adjustably attached to the flexible coupling element 5 by a ladderlock or buckle element which in each case is formed by the base 20 of a first closure member 2*a*, 2*b* or 2*c*—e.g., like a holster or a small bag is attached to a belt for a person.

The first closure members 2*a* to 2*c* may be arranged in such a way that a pair of first and second closure members 2*b*/3*b* between two other pairs of closure members 2*a*/3*a* and 2*c*/3*c* is equally spaced from both the other pairs. This is, however, not mandatory. The distances between the respective pairs may depend on the intended use and the parts to be releasable connected with each other by the closure device 1.

Due to the flexibility of the coupling element 5 a closure device 1 with several pairs of first second closure members 2*a*/3*a*, 2*b*/3*b*, 2*c*/3*c* coupled with each other may be for example used for closures for clothes in general and jackets in particular.

FIGS. 18A to 18D show a modification of the closure device 1 of FIGS. 17A to 17C. Here, in addition to the coupling of the first closure elements 2*a* to 2*c* by the coupling element 5 the second closure elements 3*a* to 3*c* are coupled to each other as well by a second coupling element 6. The narrow and elongated second coupling element 6 extends through the loop sections 312 of the straps or belts 31*a*, 31*b* and 31*c*, respectively, attached to the second closure elements 3*a*, 3*b* and 3*c*.

The second coupling element 6 thus not only couples the second closure elements 3*a* to 3*c* with each other but also prevents each strap or belt 31*a*, 31*b* and 31*c* from being detached from the corresponding second closure element 3*a*, 3*b* or 3*c*. The second coupling element 6 prevents the ends 310 of the straps or belts 31*a*, 31*b* and 31Cc to be withdrawn from the second closure elements 3*a* to 3*c* by blocking an insertion of the respective loop sections 312 into the tunnels 305. For this reason, the second coupling element 6 may be shaped like an elongated wedge element and be of triangular shape in cross-section.

By means of a strap-like second coupling element 6 as shown in FIGS. 18A to 18D the second closure members 3*a* to 3*c* are coupled with each other in such a way that the first and second closure members 2*a*/3*a*, 2*b*/3*b* and 2*c*/3*c* of the respective pairs may be subsequently detached in a zipper-like manner by just pulling at a first one in the row of second closure members, e.g., the second closure member 3*a* and/or a section of the coupling element 6 attached to it. After the first one of the second closure members is detached from its corresponding first closure member 2*a* or already upon the detaching movement the coupling element 6 transmits an opening force to the neighboring second closure element 3*b* and so on. Consequently, an opening force applied to a first one of the second closure members 3*a* or 3*c* is gradually transmitted via the second coupling element 6 to the other second closure members 3*b* to 3*c* or 3*b* to 3*a*. For applying an opening force, e.g. a person may hence just pull at one free end of the second coupling element 6.

This zipper-like principle can be embodied in any scale. This means the closure members could have just the size of one or few millimeters for apparel applications, they could have the size of centimeters for technical applications, fixation of covers in yachting or stage equipment or, in a macroscopic embodiment, have a size of dozens of centimeters for covers of containers, ships or the like. Especially in microscopic embodiments the closure members may be injection molded from a plastic/magnetic material mix like a mixture of PE or PP with NdFeB magnet material or Ferrit material and magnetized by automated process directly after injection.

In FIGS. 19A to 19F a further embodiment of a closure device 1 according to the invention is illustrated in which several pairs of first and second closure members 2*a*/3*a*, 2*b*/3*b*, 2*c*/3*c* and 2*d*/3*d* are coupled with each other by means of a belt-like coupling element 5. The belt-like coupling element 5 of FIGS. 19A to 19F may be flexible or rigid and connects neighboring first closure members 2*a* to 2*d* with other.

Each first closure member 2*a* to 2*d* may be slideably mounted to the coupling element 5 and fixed to it by a fasting member 50, e.g., in the form of a rivet. The fasting element 50 is provided at a lateral lug 26 of each first closure member 2*a* to 2*d*. Each fasting element 50 penetrates the coupling element 5 in order to secure its associated first closure member 2*a*, 2*b*, 2*c* or 2*d* in a specific position at the coupling element 5.

The first closure members 2*a* to 2*d* may be mounted to the coupling element 5 in differing numbers and in differing distances with respect to each other depending on the intended use of the closure device 1. After being placed to the desired position the first closure members 2*a* to 2*d* are subsequently fixed at the coupling element 5 by the fasting elements 50.

A closure device 1 with several first and/or second closure members 2, 2*a* to 2*c*, 2*a* to 2*d*, and 3, 3*a* to 3*c*, 3*a* to 3*d* as shown in FIGS. 14A to 14D, 17A to 17C, 18A to 18C and 19A to 19F may be designed as a preassembled module. By coupling the respective first and second closure members of such modules with an at least partially flexible coupling element 5 and/or 6 the module itself becomes at least partially flexible so that its mounting is eased and the module may, e.g., be used without further ado in connection with clothes. Connecting several pairs of first and second closure members may have furthermore the advantage that more complex closure devices may be easily fabricated. Naturally, a closure device 1 of FIGS. 14A to 14D, 17A to 17C, 18A to 18C and 19A to 19F may be provided with any of the first and second closure members 2 and 3 shown in the other drawings.

Instead of adjustably attaching a force application element 31 or 31*a* to 31*d*, for example in the form of a strap or belt as shown in FIGS. 10A to 19F, to a second closure member 3 or 3*a* to 3*d* a force application element may be rigidly attached to a second closure member 3 or 3*a* to 3*d* in such a way that an end 310 is immovably secured at the second closure member 3 or 3*a* to 3*d*. In this case an end 310 of a strap or belt is for example rigidly attached to the second closure member 3, 3*a*, 3*b*, 3*c* or 3*d* by molding. Accordingly, an end of the strap or belt may be embedded in a material of which the second closure member 3, 3*a*, 3*b*, 3*c* or 3*d* is manufactured. Hence a length of the strap or belt is predefined by the manufacturer of the closure device and may be not adjusted by a user. This may be advantageous with regard to applications in which the correct length of the strap or belt is crucial for the functionality of an assembly to which the closure device is mounted.

As already outlined with respect to the embodiment of FIGS. 17A to 17C and as regards the coupling of several pairs of first and second closure members in a closure device 1 by means of a single coupling element 5 or several coupling elements, a first or second closure member 2, 2*a* to 2*d* and 3, 3*a* to 3*d* may also be releasably fixed to a coupling element by means of a ladder lock or buckle element and/or a clamp element.

Whereas the invention has been described above with reference to a number of specific embodiments, the invention is not limited to such embodiments. Rather, the invention may be carried out in entirely different ways not described herein.

While in particular the closing of the closure devices described above has been described with regard to approaching the second closure member to the first closure member, it is to be noted that for closing in principle both closure members may be approached to each other. In this regard, only the relative movement between the closure members is of importance and not which closure member is actually moved in order to approach the closure members towards each other.

Further, in the embodiments the closure members comprise or are attached to belt receptacles such that the closure device serves to connecting belts to each other. It is to be noted, however, that the closure device may be used for entirely different purposes to connect any parts to each other.

LIST OF REFERENCE NUMERALS

1 Closure device
2, 2*a*, 2*b*, 2*c*, 2*d* Closure member
20 Base
200 Opening
201, 201A, 201B Belt receptacle
21, 21A, 21B, 21C, 21D Locking element
210 Locking protrusion
211 Tilted surface
212 Outer edge of locking protrusion
213 Recess
22 Magnet housing
220 Opening
23, 23A, 23B Magnetic member
230 Center
24, 24A, 24B Blocking element
25A, 25B Side wall
26 Lug
3, 3*a*, 3*b*, 3*c*, 3*d* Closure member
30, 30A, 30B, 30C, 30D Locking part
300 Force application location (line, point)
301, 301A, 301B Opening
3010 Front bar
3011 Rear bar
3012 Deflecting protrusion
3013 Form-fit element
302 Handle
303 Support element
3030 Lateral recess
304 Locking protrusion
305 Tunnel
306 Tilted face
307 Front face
308 Back face
309 Recess
31, 31*a*, 31*b*, 31*c*, 31*d* Force application element
310, 311 End
312 Loop section
313 Hole
32 Securing element
33, 33A, 33B Magnetic member
340 Axis
340 Recess
35 Wedge element
36 Clamp element
360 Clamp body
361 Handle
37 Coupling element
38 Securing element
380 Securing body
381 Handle
4 Magnetic field sensor
5 Coupling element
50 Fastening member
6 Second coupling element/Wedge element
C Axis
E Engagement direction
S Axis
X Closing direction
X', X" Tilting movement
Y1 Opening direction

The invention claimed is:

1. A closure device for releasably connecting two parts with each other, comprising a first closure member having a rigid first locking protrusion and a second closure member which is attachable to the first closure member and in a closed position is held on the first closure member, the second closure member having a rigid second locking protrusion, wherein the second locking protrusion can be brought into engagement with the first locking protrusion in an engagement direction and in the closed position engages the first locking protrusion in a positive locking manner, wherein the first closure member comprises a first magnet and the second closure member comprises a second magnet, the first magnet and the second magnet being constituted to magnetically attract each other when the second closure member is attached to the first closure member for closing the closure device, and a force application element in the form of a strap or belt attached to the second closure member at a force application location in the vicinity of the second locking protrusion, the force application element being constituted to introduce a force into the second closure member and being adjustably attached to the second closure member in such a way that a length of the strap or belt, being defined as the extension of the strap or belt from the second closure member, is adjusted at the second closure member.

2. The closure device according to claim 1, wherein the force application element is adjustably attached to second closure member via a ladderlock or buckle element of the second closure member at which the force application element in the form of the strap or belt is deflected at least once.

3. The closure device according to claim 1, wherein the first closure member defines at least two attachment sections so that at least two second closure members may be attached to the first closure member at the same time.

* * * * *